United States Patent [19]

Adhikari et al.

[11] 4,030,409

[45] June 21, 1977

[54] PRINTING APPARATUS CONTROLS

[75] Inventors: Manoj C. Adhikari, Wickliffe; Joseph G. Gardner, Painesville, both of Ohio

[73] Assignee: Addressograph Multigraph Corporation, Cleveland, Ohio

[22] Filed: Apr. 28, 1975

[21] Appl. No.: 572,126

Related U.S. Application Data

[63] Continuation of Ser. No. 326,920, Jan. 26, 1973, abandoned.

[52] U.S. Cl. ..... 101/47; 101/56; 101/233; 101/53; 101/247; 271/259

[51] Int. Cl.[2] ..... B41L 47/56

[58] Field of Search ..... 271/258, 259; 101/233, 101/247, 53, 47, 56

[56] References Cited

UNITED STATES PATENTS

| | | | |
|---|---|---|---|
| 2,756,673 | 7/1956 | George | 101/233 |
| 3,053,176 | 9/1962 | Shepherd | 101/53 |
| 3,056,134 | 9/1962 | Beyer | 101/233 |
| 3,320,878 | 5/1967 | Mitchell | 101/57 |
| 3,426,678 | 11/1969 | Carper et al. | 101/132.5 |
| 3,650,618 | 3/1972 | Volkers | 271/258 |
| 3,693,969 | 9/1972 | Sakamaki et al. | 271/258 |
| 3,734,604 | 5/1973 | Szostak et al. | 271/259 |
| 3,888,478 | 6/1975 | Alderman, Jr. et al. | 271/258 |

*Primary Examiner*—Edgar S. Burr
*Assistant Examiner*—William Pieprz
*Attorney, Agent, or Firm*—Russell L. Root

[57] ABSTRACT

An improved printing apparatus control system regulates the operation of a sheet feed assembly which sequentially moves sheets of material to and from a printing station and a plate feed assembly which sequentially moves printing plates to and from the printing station. A photocell detects initial movement of a leading end portion of the printed sheet of material away from the printing station under the influence of the sheet feed assembly. This photocell is also utilized to detect when the printed sheet of material has completely exited from the printing station. A second photocell detects the presence of the succeeding sheet of material at the printing station. The control system also includes a sensor which detects the removal of one printing plate from the printing station, the absence of a printing plate at the printing station, and the subsequent arrival of the next succeeding printing plate at the printing station. Part way through each operating cycle of the printing apparatus, the control system performs a checking operation to make sure that the sheets of material and printing plates have been properly fed to and from the printing station. In the event of a misfeed of either a sheet of material or printing plate, operation of the printing apparatus is stopped.

9 Claims, 22 Drawing Figures

278
280
286
281
285
284
282
283

PRINTING APPARATUS CONTROLS

This is a continuation, of application Ser. No. 326,920 filed Jan. 26, 1973, and now abandoned.

BACKGROUND

The genesis of machine addressing probably is shown in the U.S. Pat. 558,936 issued Apr. 28, 1896 to Joseph S. Duncan, one of the founders of the business later to become the Addressograph Multigraph Corporation. Slow as it was, it provided accurate addressing from fixed plates.

From such start, a sophisticated line of business machines, such for example as the one shown in U.S. Pat. No. 2,359,850, were developed to do repetition printing of addresses and other fixed information from metal plates stored in a long storage drawer. These machines are designed for long hard service conditions of large mailing demands.

The present invention provides an improved system for controlling the operation of plate and sheet feed assemblies in a printing apparatus. The control system includes a detector arrangement which detects the removal of a printed sheet of material from the printing station and the arrival of a succeeding sheet of material at the printing station. A second detector arrangement detects the removal of one printing plate from the printing station and the arrival of a succeeding printing plate at the printing station. The control system will interrupt operation of the printing apparatus in response to a failure of a previously printed sheet of material to be removed from the printing station or a failure of a succeeding sheet of material to arrive at the printing station. In addition, the control system will interrupt operation of the printing apparatus in response to a failure of one of the printing plates to be removed from the printing station or a failure of a succeeding printing plate to arrive at the printing station.

Accordingly, it is an object of this invention to provide a new and improved printing apparatus having a control system for controlling the operation of sheet and plate feed assemblies wherein the control system is operable to interrupt operation of the printing apparatus in response to improper feeding of either a sheet of material or a printing plate.

Another object of this invention is to provide a new and improved apparatus for printing on each one of a plurality of sheets of material in turn at a printing station with a plurality of printing plates and wherein the apparatus includes a sensor which detects initial movement of the leading end portion of a first sheet of material from a printing station under the influence of a sheet feed assembly and a control system which will initiate movement of a succeeding sheet of material toward the printing station in response to detection of movement of the leading end portion of the first sheet material from the printing station.

Another object of this invention is to provide a new and improved apparatus for printing on each one of a plurality of sheets of material in turn at a printing station with printing plates and wherein the apparatus includes a reciprocatable plate feed device which is movable from an extended position in which it extends into a plate holder to a retracted position in which the plate feed device is spaced from the plate holder to thereby effect movement of a printing plate toward a printing station and a control system which is operable to interrupt operation of the printing apparatus with the plate feed device in the retracted position in response to an improper feeding of either a printing plate or a sheet of material.

DESCRIPTION OF ONE EMBODIMENT

Figure 1:
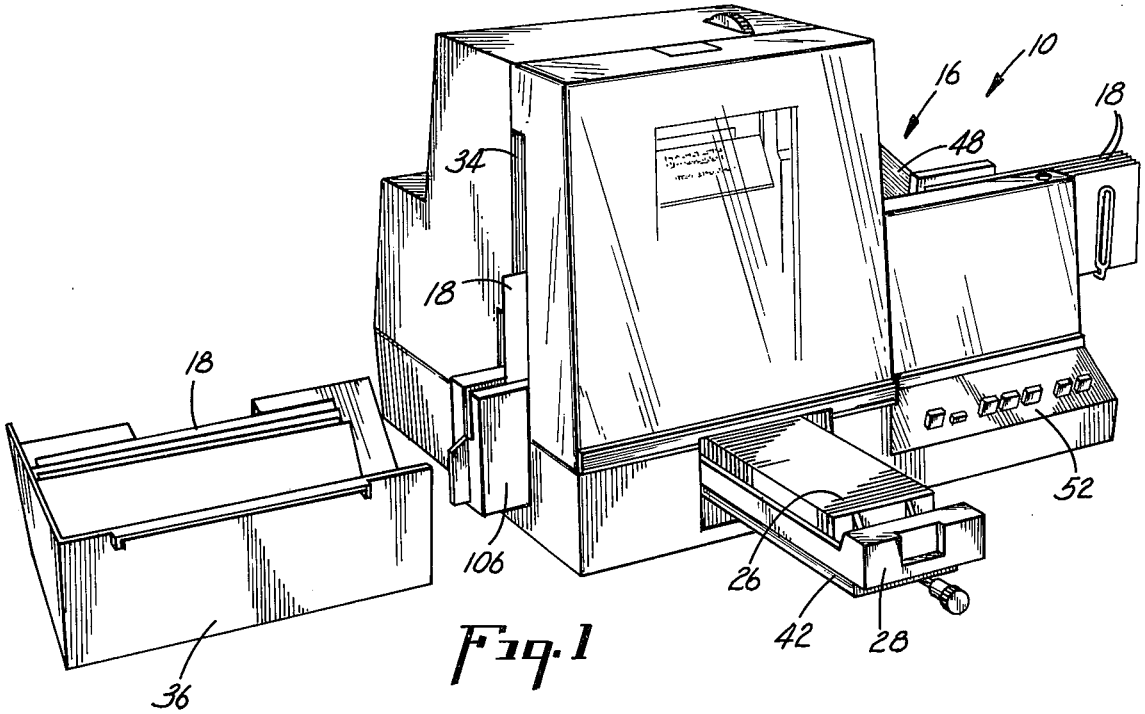
FIG. 1 is a pictorial view of a printing apparatus constructed in accordance with the present invention.
Figure 2:
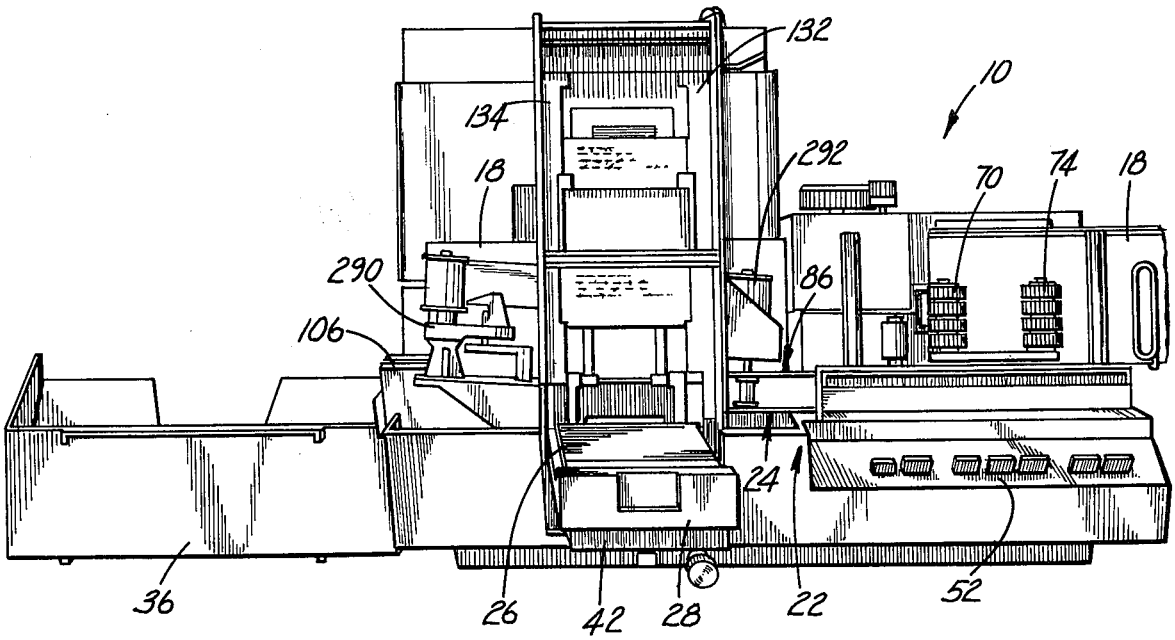
FIG. 2 is an elevational view of the printing apparatus of FIG. 1.
Figure 3:
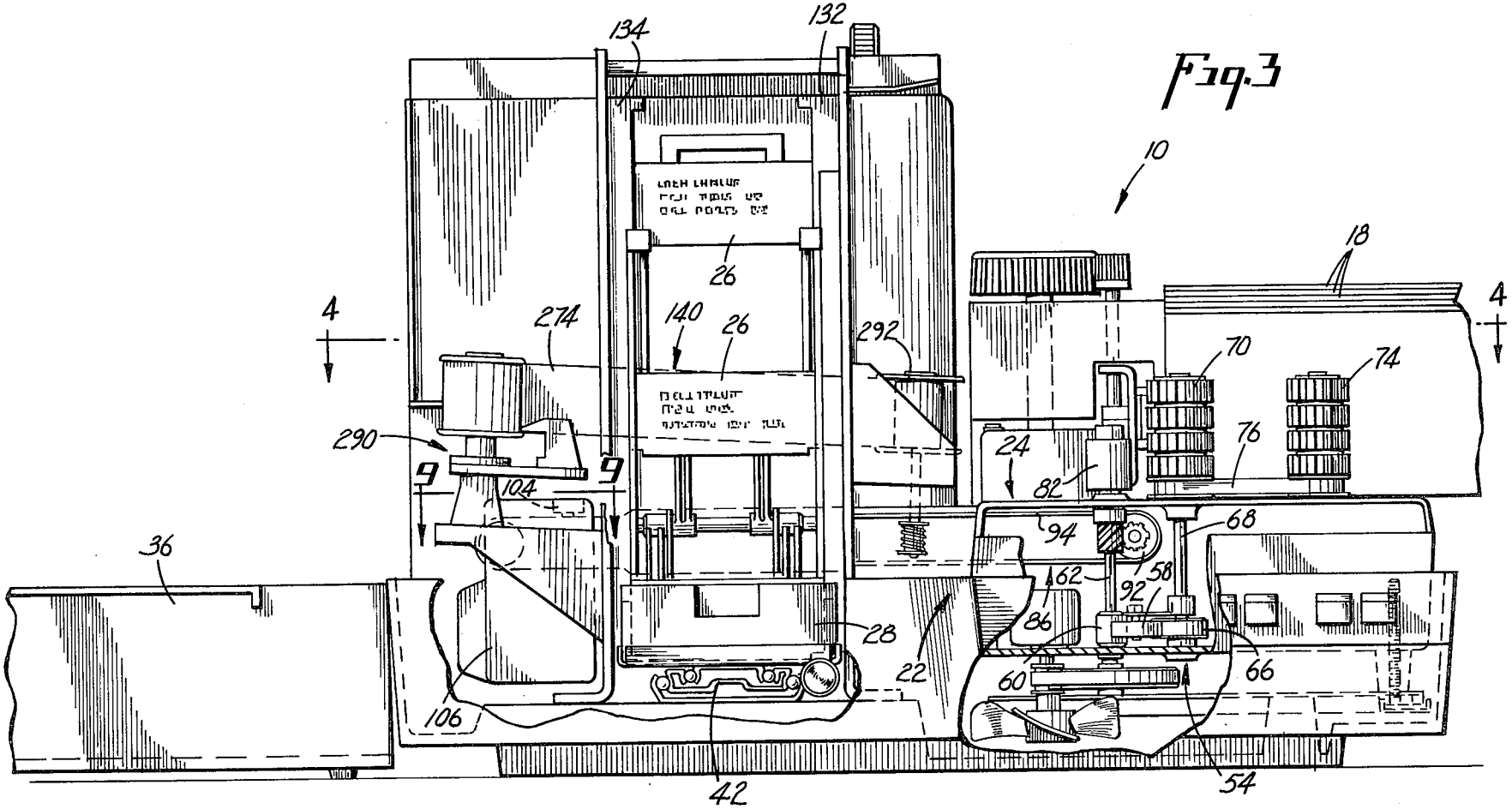
FIG. 3 is an enlarged elevational view similar to FIG. 2.

A printing apparatus 10 constructed in accordance with the present invention is shown in FIGS. 1–4 and includes a sheet material supply hopper 16 in which a plurality of sheet material articles, such as envelopes 18, are stored on edge in an upright orientation. The upright envelopes 18 are transported one at a time from the supply hopper 16 along a horizontal path to a printing station 20 by a sheet feed and transport assembly 22 which includes a conveyor 24 (FIG. 3). Printing plates 26 are moved sequentially along a vertical path from a removable drawer 28 to the printing station 20 by a plate feed mechanism 32 (FIG. 5). During a printing operation, data is transferred from one of the printing plates 26 to one of the envelopes 18 at the printing station 20. As a next succeeding envelope is moved toward the printing station 20 by the conveyor assembly 22, the printed envelope is discharged through an opening 34 to a receiving tray 36 (FIG. 1). While this is occurring, a next succeeding printing plate 26 is moved toward the printing station 20 and the used printing plate is returned to the plate storage drawer 28 by the plate feed mechanism 32. After all of the printing plates 26 have been removed from and returned to the storage drawer 28, the drawer may be removed from a holder 42 and returned to a suitable storage cabinet.

Figure 8:
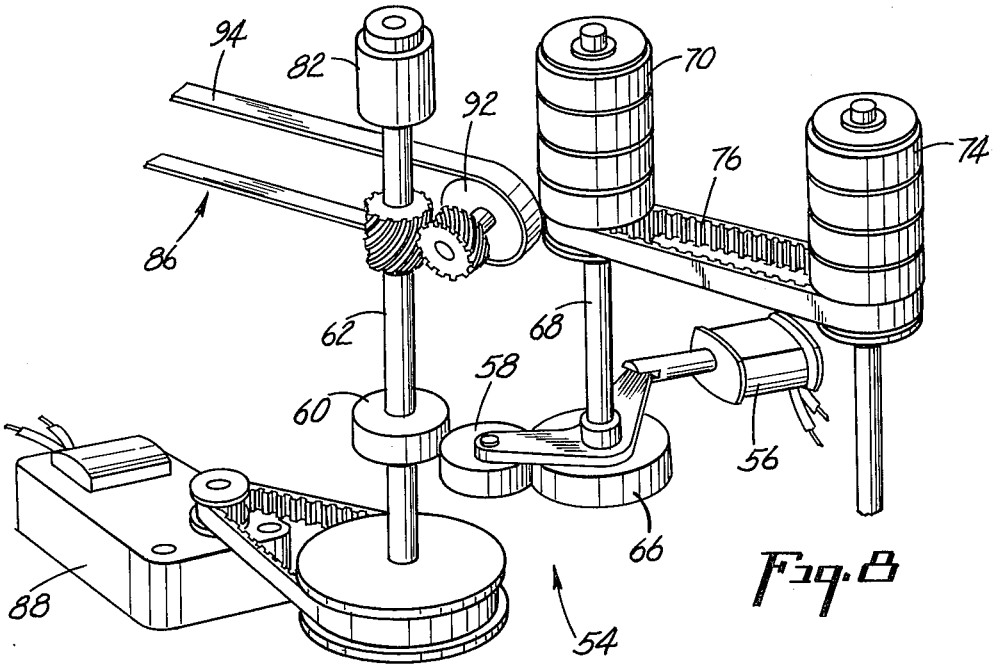
FIG. 8 is a schematic illustration of a sheet feed apparatus.

The envelopes 18 are stored in the hopper 16 with their face surfaces extending vertically upright and with their lower edge portions disposed in engagement with a support surface 48 (FIG. 4) which slopes downwardly toward a front control panel 52. When an envelope 18 is to be transferred from the supply hopper 16 to the printing station 20, an intermittent drive assembly 54 is activated by energizing a solenoid 56 for a short time to move a drive disc 58 into a frictional pressure relationship with a continuously rotating friction wheel 60 on a drive shaft 62 (see FIGS. 3 and 8). When the drive disc 58 is in abutting engagement with the friction wheel 60, a drive wheel 66 rotates a drive shaft 68 which is connected directly to an upstanding drive roller 70 and is connected with a second drive roller 74 by a flexible drive belt 76. The drive rollers 70 and 74 are driven in a counterclockwise direction (as viewed in FIG. 4) to move a forwardmost one of the envelopes 18 toward an acceleration nip 78 formed between an idler roller 80 and a continuously driven drive roller 82. The envelope is urged against the drive rollers 70 and 74 under the influence of a source of low pressure or suction provided by a blower 83. Air is drawn from the area between drive rollers 70 and 74 to the blower 83 through a conduit 84. As the envelope enters the nip 78, it is accelerated onto a continuously driven conveyor belt 86 which engages the lowermost edge portion of the envelope. The conveyor belt 86 and intermittent drive assembly 54 are both driven by a transport motor 88 (FIG. 8).

The conveyor belt 86 engages a lower edge of an envelope 18 and transports it to the printing station 20 with the envelope in an upright position, that is with the opposite face surfaces of the envelope 18 disposed in a vertical orientation. The conveyor belt 86 is continuously driven by pulley 92 to move an envelope supported on a horizontal upper run 34 of the conveyor belt 86 toward the left (as viewed in FIG. 3) from the supply hopper toward the printing station 20.

Figure 4:
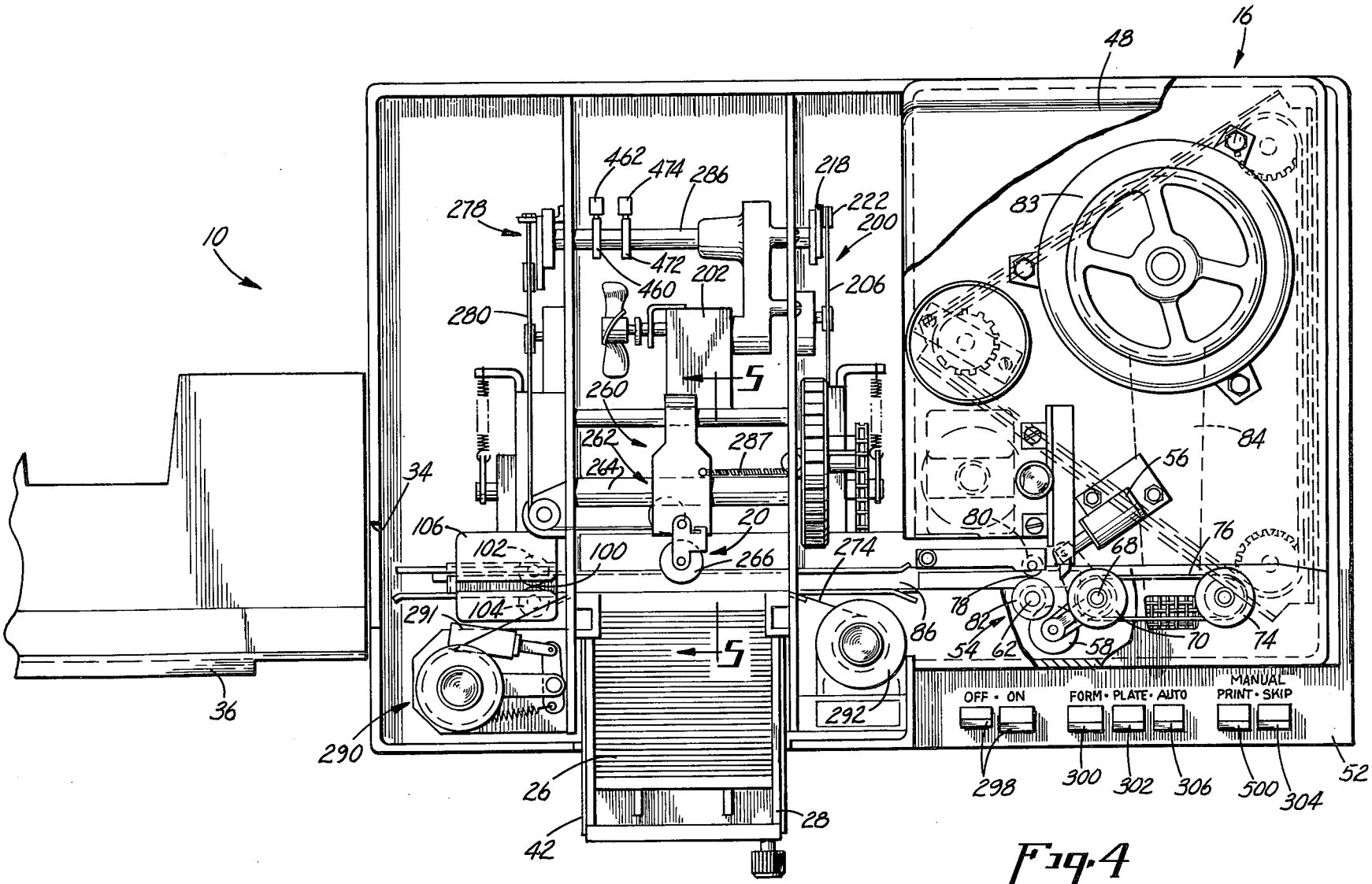
FIG. 4 is a plan view, taken generally along the line 4—4 of FIG. 3.
Figure 5:
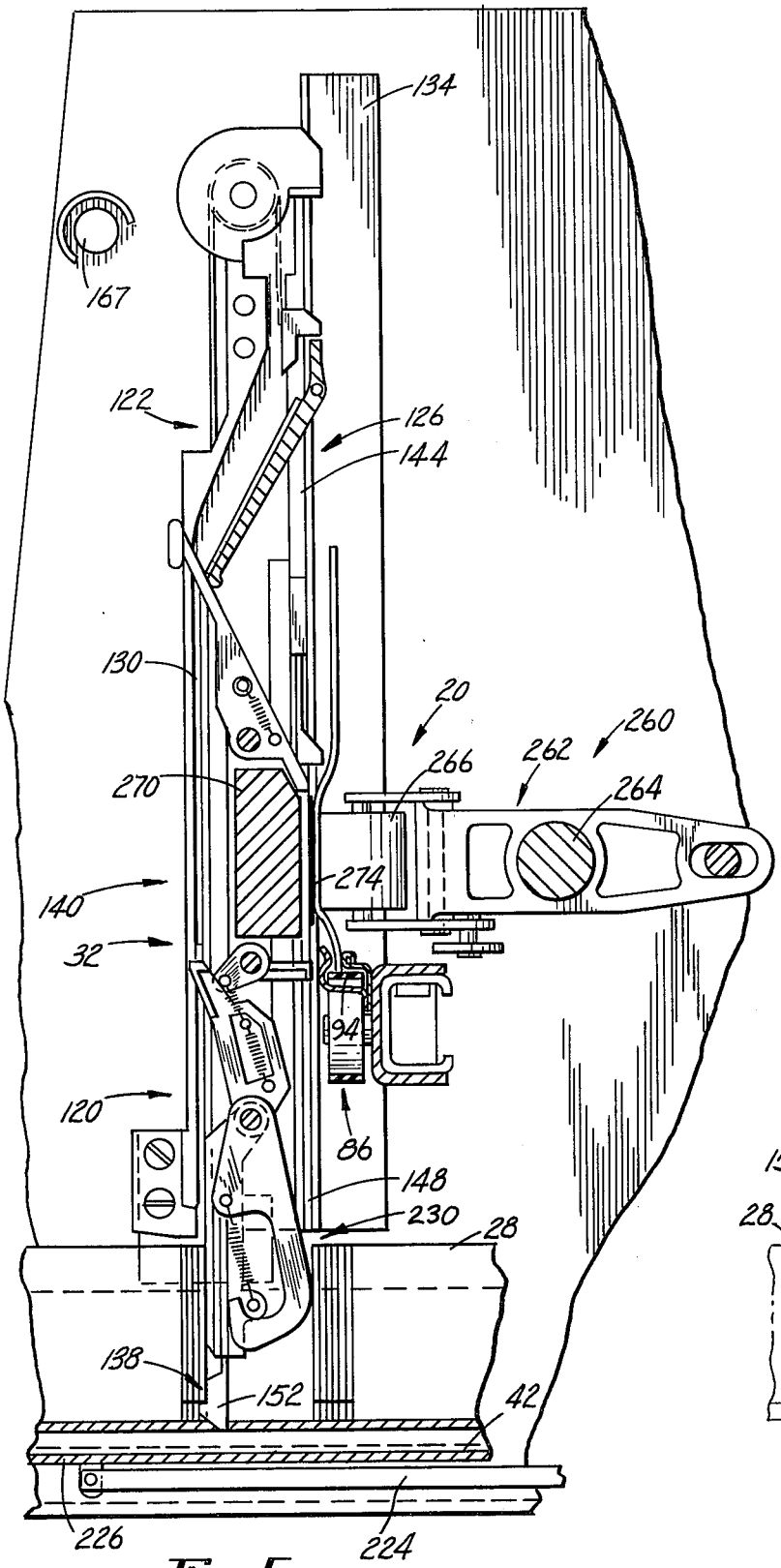
FIG. 5 is an elevational sectional view, taken generally along the line 5—5 of FIG. 4.
Figure 9:
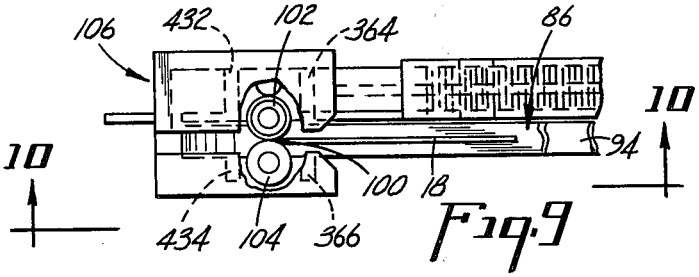
FIG. 9 is an enlarged plan view, taken generally along the line 9—9 of FIG. 3.
Figure 10:
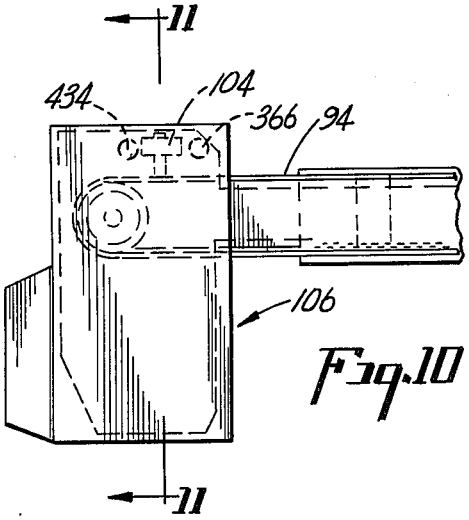
FIG. 10 is an elevational view, taken generally along the line 10—10 of FIG. 9.

When the envelope 18 reaches the printing station 20, a leading edge of the envelope is stopped by engagement with a registration nip 100 formed by a pair of rollers 102 and 104 in an assembly 106 (FIGS. 4, 9 and 10). Engagement of the leading edge of envelope 18 with the nip 100 registers the envelope longitudinally relative to the printing station 20 and holds the envelope stationary so that the upper run 94 of the conveyor belt 86 slides along the lower edge of the upright envelope.

Figure 11:
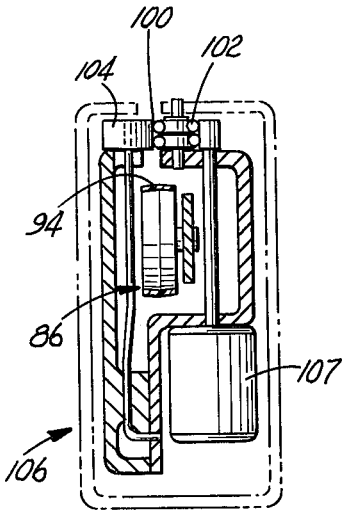
FIG. 11 is a sectional view taken generally along the line 11—11 of FIG. 10.

The envelope 18 remains in the upright orientation at the printing station 20 while data is transferred from a printing plate 26 to the envelope. After this printing operation has taken place, the drive roller 102 is rotated by a registration motor 107 (FIG. 11) to move the upright envelope 18 through the opening 34 (FIG. 1) into the receiving tray 36. It should be noted that the assembly 106 can be moved from the retracted position shown in FIG. 4 to the extended position shown in FIG. 1 to register different portions of an envelope 18 relative to a printing plate 26 at the printing station 20 or to center envelopes of different lengths.

The specific construction of the sheet feed and transport assembly 22 is more fully disclosed and claimed in U.S. Application Ser. No. 327,064, filed on Jan. 26, 1973, by Joseph B. Gardner et al, and entitled "Form Feed and Transport Assembly", now U.S. Pat. No. 3,902,411. It should be understood that the specific construction of the sheet feed and transport assembly is not part of the present invention. The sheet feed and transport assembly 22 could be utilized to transport other sheet material articles, such as pamphlets, to the printing station 20.

Figure 6:
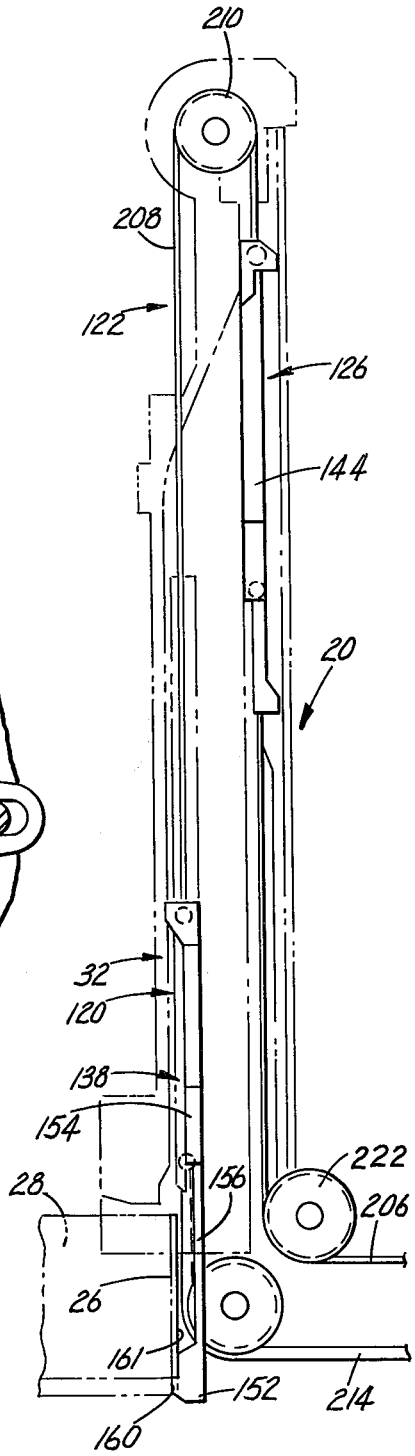
FIG. 6 is a schematic elevational view, generally similar to FIG. 5.

Contemporaneously with movement of an envelope 18 to the printing station 20, a printing plate 26 is moved to the printing station 20 by the plate feed mechanism 32 (FIG. 5). The plate feed mechanism 32 includes a front plate feed assembly 120 (FIG. 6) which removes each of the printing plates 26 in turn from the drawer 28 and moves them upwardly toward an inspection station 122. A rear plate feed assembly 126 engages each of the printing plates 26 in turn at the inspection station 122 and moves them downwardly to the printing station 20. After completion of a printing operation in which data is transferred from the printing plate to an envelope 18, the rear plate feed assembly 126 returns the printing plate 26 to the removable storage drawer 28.

It is contemplated that the printing plates 26 will be located in the storage drawer 28 in a predetermined order, such as in either alphabetical or numerical sequence. To enable this order to be maintained, the printing plates are returned to the drawer 28 in the same sequential position in which they are disposed prior to being removed from the drawer by the front plate feed assembly 120. This enables the drawer 28 to be removed from the printing apparatus 10 and returned to its storage location with printing plates 26 in their original order in the drawer.

The front plate feed assembly 120 lifts the printing plates upwardly along a pair of vertical tracks 130 (FIG. 5) which are formed in upright tower side members 132 and 134 (see FIG. 3). Although only one of the tracks 130 in the tower member 134 has been shown, it should be understood that a similar track is formed in the tower member 132 and opens outwardly toward the track 130.

The front plate feed assembly 120 includes a right front feed finger (not shown) and a left front feed finger 138 (see FIG. 5) The left and right front feed fingers are each disposed in a vertical guide track formed in and associated with one of the tower members 132 and 134. The front feed fingers engage the lower edge portion of a printing plate disposed in the drawer 28 (FIG. 6) and are moved upwardly together to raise the printing plate from the storage drawer to an intermediate station 140 and from the intermediate station 140 to the inspection station 122. Similarly, the rear plate feed assembly 126 includes a right rear feed finger (not shown) and a left rear feed finger 144 which are slidably disposed in vertical rear tracks in the upright tower members 132 and 134, only the rear track 148 for the left rear feed finger 144 being shown in FIG. 5. The two rear feed fingers push a printing plate vertically downwardly from the inspection station 122 to the printing station 20 and from the printing station 20 back into the plate storage drawer 28. Since the front plate feed assembly 120 moves the printing plates 26 vertically upwardly and the rear plate feed assembly 126 moves the printing plates vertically downwardly, the printing plates move along a substantially vertical path having a vertical front or upward path length and a vertical rear or downward path length.

The front feed finger 138 (FIG. 6) includes a lower end portion 152 which is connected with a main body 154 by a longitudinally extending connector section 156. As the front feed finger 138 is moved downwardly to the position shown in FIGS. 6 and 7A, the connector section 156 is resiliently deflected rearwardly by engagement of a nose portion 160 with an inner surface 161 of a printing plate 26a (FIG. 7A).

Contemporaneously with this engagement of the lower end portion 152 of the feed finger 138 with the printing plate 26a, upper end portion 162 of the feed finger 138 moves beneath the horizontal lower edge portion of a printing plate 26b disposed at the intermediate station 140. The upper end portion 162 of the feed finger 138 is connected with the body 154 of the feed finger by a resiliently deflectable connector portion 166. The connector portion 166 is deflected rearwardly by engagement of the upper end portion 162 of the feed finger 138 with the printing plate 26b as the feed finger moves to the pickup position of FIG. 7A.

Figures 7A, 7B, 7C:
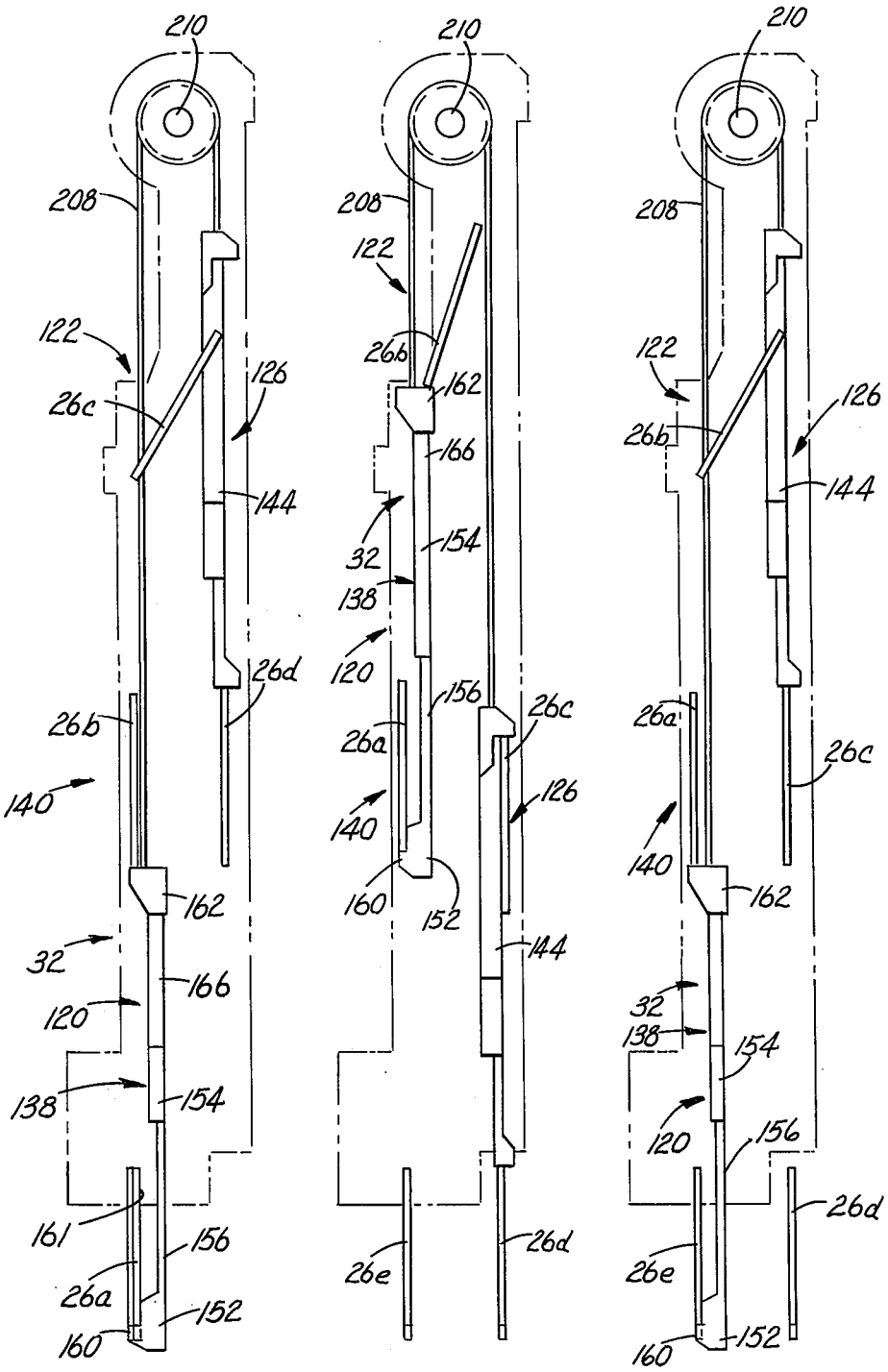
FIG. 7A is a schematic illustration depicting a plate feed mechanism immediately before a printing plate is lifted from a storage drawer by plate feed fingers.
FIG. 7B is a schematic illustration, generally similar to FIG. 7A.
FIG. 7C is a schematic illustration depicting the plate feed mechanism engaging the next succeeding printing plate in the plate storage drawer.

During upward movement of the front feed finger 138 from the position shown in FIG. 7A to the position shown in FIG. 7B, the front feed finger raises the printing plate 26a from the storage container 28 to the intermediate station 140. Simultaneously with this movement of the printing plate 26a to the intermediate station 140, the printing plate 26b is moved upwardly from the intermediate station 140 (FIG. 7A) to the inspection station 122 (FIG. 7B). The printing plate 26b is illuminated at the inspection station 122 by a suitable light 167.

Simultaneously with this vertical movement of printing plates 26a and 26b upwardly to the intermediate station 140 and inspection station 122, preceding printing plates 26c and 26d are moved downwardly by the rear feed fingers. Thus, the rear feed finger 144 engages a printing plate 26c at the inspection station 122 (FIG. 7A) and moves it downwardly to the printing station 20 (see FIG. 7B). As the printing plate 26c is moved to the printing station 20, the printing plate 26d is moved from the printing station 20 (FIG. 7A) to the storage drawer 28 (FIG. 7B) by the rear face plate feed assembly 126. When the printing plate 26d has been returned to the storage drawer 28, its rear face surface is disposed in abutting planar engagement with the front face surface of the printing plate which immediately precedes it in the series of printing plates in the storage drawer.

After returning the printing plate 26d to the storage drawer and moving the printing plate 26c to the printing station, the plate feed mechanism 32 initiates a return stroke. It should be noted that the front and rear plate feed assemblies 120 and 126 are disposed above the storage drawer 28 during the initial portion of the return stroke. As the return stroke continues the lower end portion 152 of the front feed finger moves into engagement with the next printing plate 26c (FIG. 7C) in the drawer 28.

After the completion of a printing operation with the printing plate 26c, the front and rear feed fingers 138 and 144 are again moved through vertical feed strokes during a next succeeding operating cycle. This moves the printing plate 26e from the drawer 28 to the intermediate station 140 and returns the used printing plate 26c to the drawer to its initial sequential relationship with the other printing plates in the drawer. Of course, the printing plate 26a is advanced to the inspection station 122 and the printing plate 26b is moved to the printing station 20 as the printing plate 26c is returned to the drawer. In this manner the printing plates 26 are each removed in turn from the drawer 28, advanced to the printing station 20 and returned to the drawer by the operation of the plate feed mechanism 32.

The front and rear feed fingers 138 and 144 are moved up and down together in unison by a feed finger drive assembly 200 (see FIGS. 4 and 6) which is driven by a main drive motor 202 (FIG. 4). The drive assembly 200 includes a cable 206 (see FIG. 6) which is connected to the rear feed finger 144. The rear feed finger 144 is connected to the front feed finger 138 by a cable 208 which extends around an idler pulley 210. A resilient biasing spring 214 (see FIG. 6) is connected to the lower end of the body 154 of the front feed finger 138 and continuously pulls the front feed finger 138 downwardly. This biasing force is transmitted by the cable 208 to the rear feed finger 144 to urge the rear feed finger 144 upwardly in the track 148.

During operation of the drive assembly 200, a crank arm 218 (FIG. 4) pulls the cable 206 around a pulley 222 (FIG. 6) to raise the front feed finger 138 and lower the rear feed finger 144. As the front feed finger 138 is raised, the coil spring 214 is stretched. At the end of an upward stroke of the front feed finger 138 and a downward stroke of the rear feed finger 144, the crank arm 218 releases the cable 206 so that the biasing spring 214 pulls the front feed finger 138 downwardly and the rear finger 144 upwardly through return strokes.

Although only the connections between the drive assembly 200 and the left feed fingers 138 and 144 have been shown, it should be understood that the right feed fingers are connected with the crank arm 218 in the same manner. Thus, a cable, similar to the cable 206, extends to the right rear feed finger which is connected with the right front feed finger by a cable, similar to the cable 208. The right front feed finger is urged to the downward position by a coil spring, similar to the spring 214.

The specific construction of the feed fingers 138 and 144, the manner in which they are mounted in the upstanding tower member 132 and 134, and the manner in which the drive assembly 200 is connected with the feed fingers is more fully disclosed and claimed in U.S. Application Ser. No. 327,051 filed on Jan. 26, 1973 by Gary G. See et al, and entitled "Plate Feed Mechanism", now U.S. Pat. No. 3,905,293. The specific construction of the various components of the plate feed mechanism 32 does not per se form a part of the present invention.

Each time a printing plate 26 is removed from the storage drawer 28, the storage drawer is moved rearwardly, that is toward the right as viewed in FIG. 5, to move a next succeeding printing plate into position to be engaged by the plate feed mechanism 32 during the next cycle of operation of the plate feed mechanism. To provide for this rearward or inward movement of the plate storage drawer 28, the drawer is disposed in the movable holder assembly 42 which is continuously urged inwardly by an indexing spring 224 (FIG. 5). The indexing spring 224 is connected to a longitudinally extending frame member 226 of the holder assembly 42. The indexing spring 224 is of the negator type so that a continuous rearward biasing force of a substantially constant magnitude is applied to the holder assembly 42 by the indexing spring 224 as the drawer 28 and holder assembly are moved rearwardly.

A printing assembly 260 (see FIGS. 4 and 5) at the printing station 20 prints on each of envelopes 18 in turn with a different one of the printing plates 26 between operating cycles of the plate feed mechanism 32. The printing assembly 260 includes a roller platen 262 which is reciprocated from right to left (as viewed in FIG. 4) along a support rod 264 to move an impression roller 266 through a printing stroke across an anvil 270. The printing plate at the printing station 20 is disposed between the anvil 270 and a printing ribbon 274. Upon movement of the printing roller 266 from right to left (as viewed in FIG. 4) the roller presses an envelope 18 against the ribbon 274, printing plate 26, and anvil 270 to imprint data on the envelope 18 in a known manner (see FIG. 5).

Once the roller platen 262 reaches the end of its leftward stroke (as viewed in FIG. 4) the printing roller 266 is toggled to a retracted position and the roller platen 262 is moved from the left to right during a return stroke in which the printing roller is spaced from the envelope 18. During this return stroke, the drive roller 102 in the form stop and exit control assembly 106 is rotated at a relatively high speed to accelerate the printed envelope away from the printing station 20 through the exit opening 34 and into the receiving tray 36. As the printed envelope is moved away from the printing station 20, a next succeeding envelope 18 is moved toward the printing station by the conveyor assembly 22. In addition, the plate feed mechanism 32 is activated to move a next succeeding printing plate 26 to the printing station.

Figure 12:
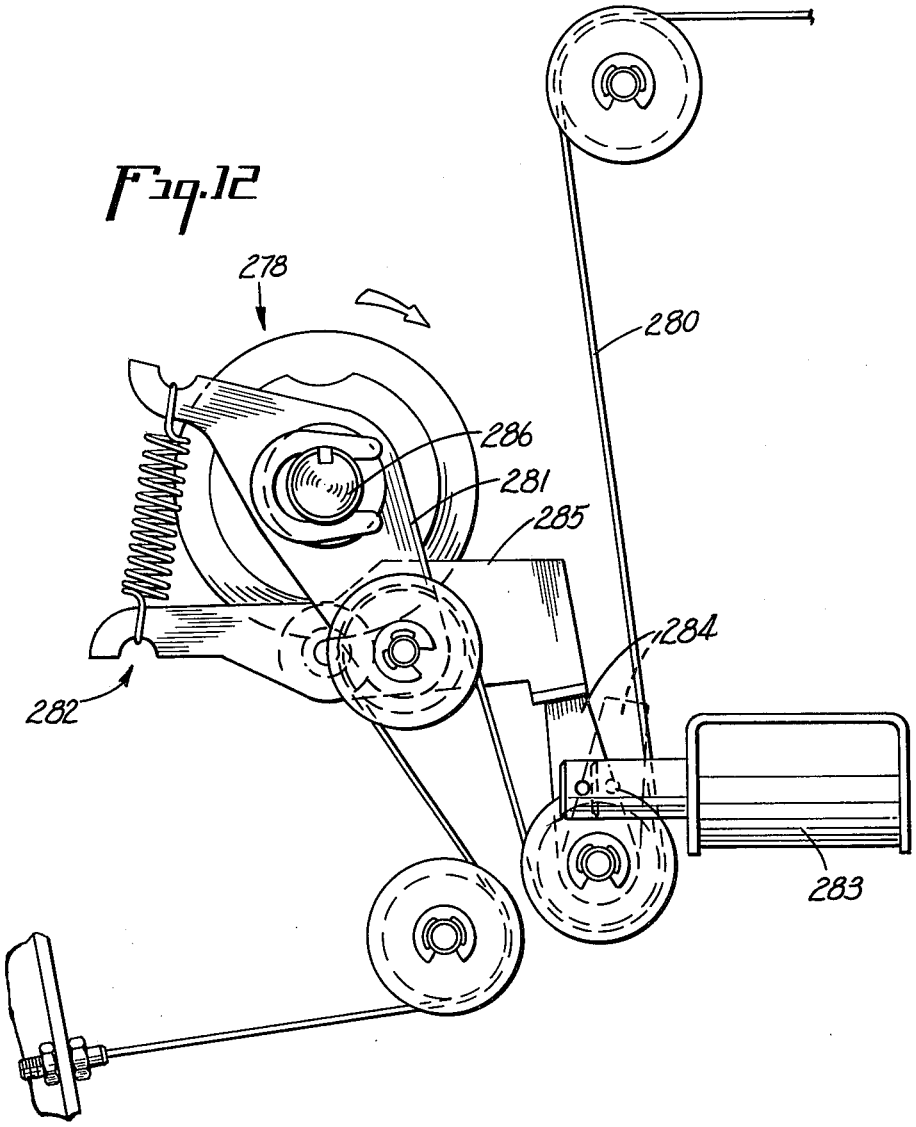
FIG. 12 is a schematic illustration of a printing plate drive mechanism.

The roller platen 262 is reciprocated back and forth through printing and return strokes by a printing drive assembly 278 (FIGS. 4 and 12) which is connected with the roller platen 262 by suitable cables 280. The printing drive mechansim 278 includes a crank arm 281 (FIG. 12) which is driven by the main motor 202 through a clutch mechanism 282. Since both the printing drive mechanism 278 and the plate feed mechanism 32 are powered by the motor 202, the maintaining of these two mechanisms in synchronism with each other is facilitated.

When the roller platen 262 is to be moved through a printing stroke, a solenoid 283 is energized to pivot an arm 284 out of the way of a clutch actuator lever 285. This enables drive forces to be transmitted through the engaged clutch 282 from a shaft 286 driven by the main motor 202 to the crank arm 281. Therefore, operation of the motor 202 results in rotation of the crank arm 281 through 180° (in a clockwise direction as viewed in FIG. 12) and movement of the roller platen 262 through a printing stroke. A return spring 287 (FIG. 4) moves the roller platen 262 through a return stroke as the crank arm 281 continues its rotation, in the clockwise direction (as viewed in FIG. 12), back to the position shown in FIG. 12.

If the printing assembly 260 is to be operated through a single printing stroke, the solenoid 283 is deenergized before completion of a return stroke of the roller platen 262. Since the clutch actuator lever 285 rotates with the crank arm 281 and shaft 286 when the clutch 282 is engaged, deenergizing the solenoid 283 releases the arm 284 for movement into the path of rotation of the clutch actuator lever 285. Therefore at the end of a return stroke, the clutch actuator lever 285 engages the arm 284. This causes the clutch 282 to be disengaged and prevents operation of the printing assembly 260 during subsequent operation of the main drive motor 202 with the solenoid 283 deenergized.

When printing operations are to be resumed, it is merely necessary to energize the solenoid 283 and pull the arm 284 out of the way of the clutch actuator lever 285. It should be noted that the clutch 282 is of the type which can be operated from the disengaged condition to the engaged condition only when the shaft 286 is in a predetermined rotational position relative to the crank arm 281. This results in actuation of the printing assembly 260 in the same relationship with the plate feed mechanism 32 each time the clutch 282 is engaged.

The construction of the printing assembly 260 is more fully described and claimed in copending application Ser. No. 447,234, filed on Mar. 1, 1973, by Gary G. See, and entitled "Platen Alignment Control", now U.S. Pat. No. 3,893,393. Although the specific construction of the printing assembly 260 does not, per se, form a part of the present invention, it is believed that the printing assembly is particularly well suited for use in the printing apparatus 10. However, it should be understood that other suitable known printing assemblies could, if desired, be utilized.

Each time the roller platen 262 is moved through a printing stroke, a ribbon indexing assembly 290 (FIG. 4) is activated to index the ribbon 274 relative to the anvil 270. The ribbon indexing assembly 290 is of a known construction and includes a solenoid 291 which indexes the ribbon 274 through equal increments each time the assembly is activated. Activation of the ribbon indexing assembly 290 removes ribbon from a supply reel or spool 292.

When the printing apparatus 10 is to be operated, a tray or drawer 28 of printing plates 26 is removed from a suitable storage location and manually carried to the printing apparatus 10. The holder 42 is then withdrawn by pulling it ouwardly against the influence of the indexing spring 224. The drawer 28 is then deposited in the holder 42 with the packing or indexing assembly 230 between the back of the drawer and the rearwardmost printing plate 26. The drawer holder 42 is released and the spring 224 pulls the drawer 28 and holder 42 rearwardly until properly aligned for engagement by the front feed fingers of the plate feed mechanism 32.

An on-off switch 298 on the control panel 52 is then depressed to enable the printing apparatus 10 to be set up for manual operation. A form switch 300 is depressed to enable the feeding of a first envelope 18 to the printing station 20. A plate feed switch 302 on the control panel 52 is then actuated to activate the plate feed mechanism 32. During starting, the plate feed mechanism is in a position shown in FIG. 7B with no plates in the track. First actuation of the plate feed switch 302, moves the plate feed mechanism 32 from its midcycle position shown in FIG. 7B to start cycle position shown in FIG. 7A. The plate feed switch 302 when actuated second time activates the plate feed mechanism 32 and lifts a first printing plate 26 vertically upwardly from the drawer 28 to the intermediate station 140. When this occurs, the spring 224 moves the drawer 28 and holder 42 rearwardly to position the next succeeding printing plate 26 for engagement by the plate feed mechanism 32. When the plate feed switch 302 on the control panel 52 is depressed two more times, (total of four times since starting) the plate feed mechanism 32 moves the first printing plate up to the inspection station 122 and the next succeeding printing plate up to the intermediate station 140. When the first printing plate is disposed at the inspection station 122, it is illuminated by the light 167 and is clearly visible to an operator of the printing apparatus 10. At this time the plate feed mechanism is in midcycle postion as shown in FIG. 7B with plates in the station 140 and 122. One more actuation of the plate feed switch 302 (fifth since starting) is required to bring the plate feed mechanism in start cycle position as shown in FIG. 7A. The first plate which arrived in the inspection station 122 at the end of the fourth actuation of the plate feed switch 32 remains in the inspection station 122 at the end of fifth actuation of the plate feed switch 302 and is clearly visible to the operator. At the end of the fifth actuation of the plate switch 302, the plate feed mechanism is at the start cycle position. At this time the operator has to make sure of the following three choices. If it is not desired to print with the printing plate visible in the inspection station 122, the operator may subsequently depress a skip switch 304 on the control panel 52. Actuation of the skip switch cycles the plate feed mechanism 32 through one operating cycle (start cycle position to start cycle position, FIG. 7A), but does not activate the printing assembly when that printing plate is at print station 20.

The second alternative is, the operator may desire to print the plate in the inspection station 122. If so, the print switch 500 on the control panel 52 is depressed. (Further explanation of print cycle is explained hereafter).

The third alternative to the operator is to switch to automatic mode of operation by depressing Auto switch 306 on control panel 52.

When this occurs, automatic operation of the printing apparatus 10 is initiated. During each complete cycle of operation, a printing plate is lifted from the plate storage drawer 28 and started along the vertical path to the printing station 20. Also, on each cycle of operation of the apparatus 10, the conveyor assembly 22 moves an envelope 18 from the storage hopper 16 to the printing station 20. As soon as a printing operation has been performed at the printing station 20 to transfer data from a printing plate 26 to the envelope 18, the envelope is moved further along its horizontal path and through the exit opening 34 by the form stop and exit control assembly 106. At the same time, the used printing plate is moved vertically downwardly from the printing station 20 and returned to the drawer 28 by the plate feed mechanism 32. While one printing plate is being returned to the drawer 28, a next succeeding printing plate is moved to the printing station 20 and another printing plate is removed from the drawer 28.

When operation of the printing apparatus 10 is to be initiated, it is necessary to activate control circuitry (FIGS. 13 through 15E) to set up the printing apparatus. To initiate setting up the printing apparatus 10, the on-off switch 298 (FIG. 15B) is closed to activate the blower 83 (FIGS. 4 and 15B) to apply suction to the outermost envelope in the hopper 16. In addition, closing the on-off switch 298 energizes the transport motor 88 (FIGS. 8 and 15B) which continuously drives the conveyor belt 86. Also, closing the switches 298 energizes the light 167 for illuminating a printing plate 26 at the inspection station 122. However, it should be noted that the main drive motor 202 is not connected across a pair of power lines 340 and 342 and therefore is not immediately energized upon actuation of the on-off switches 298.

After the printing apparatus 10 has been activated by depressing the on-off switch 298, it is necessary to feed a first envelope 18 from the hopper to the printing station 20 and to move a first printing plate 26 from the drawer 28 to the inspection station 122. The first envelope is moved to the printing station 20 upon actuation of a form transport switch 300 on the control panel 52 (FIG. 4). Actuating the form transport switch 300 (FIG. 15E) opens a lead 348 which is connected to ground. Opening the lead 348 interrupts a flow of current from a positive 15-volt DC source 352 through the switch 300 to ground. When the switch 300 is opened the input to a terminal 354 of a NAND gate 356 changes from logic zero to logic one.

If for some unforeseen reason an envelope was at the printing station 20 upon pressing the form feed switch 300, the feeding of a second envelope at the printing station would cause a malfunction of the printing apparatus 10. Accordingly, a terminal 358 of the NAND gate 356 is connected by a lead 360 to the output of amplifier 362 (see FIG. 13). The amplifier 362 is connected with a photocell 364 which is illuminated by light from a lamp 366 when an envelope is not present at the printing station 20. The lamp 366 is disposed immediately before the registration nip 100 formed by the rollers 102 and 104 (see FIGS. 9 and 10). Therefore, when an envelope is present at the printing station 20 its leading end portion will block the transmission of light from the lamp 366 to the photocell 364 to thereby render the photocell non-conducting and apply a logic one input from a 15-volt DC source 368 to an inverter 370 connected to the amplifier 362.

Figure 15A:
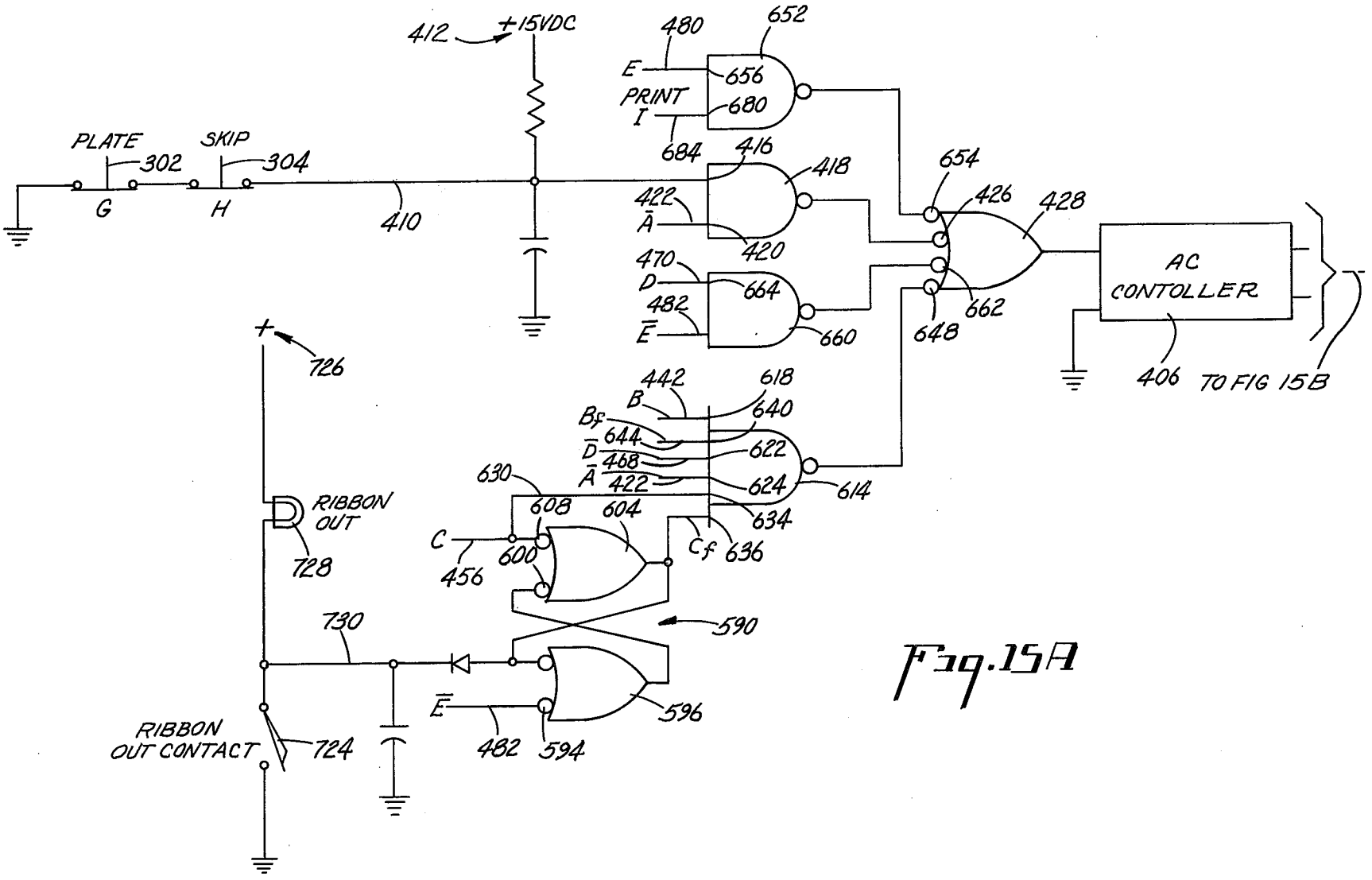
Figure 15B:
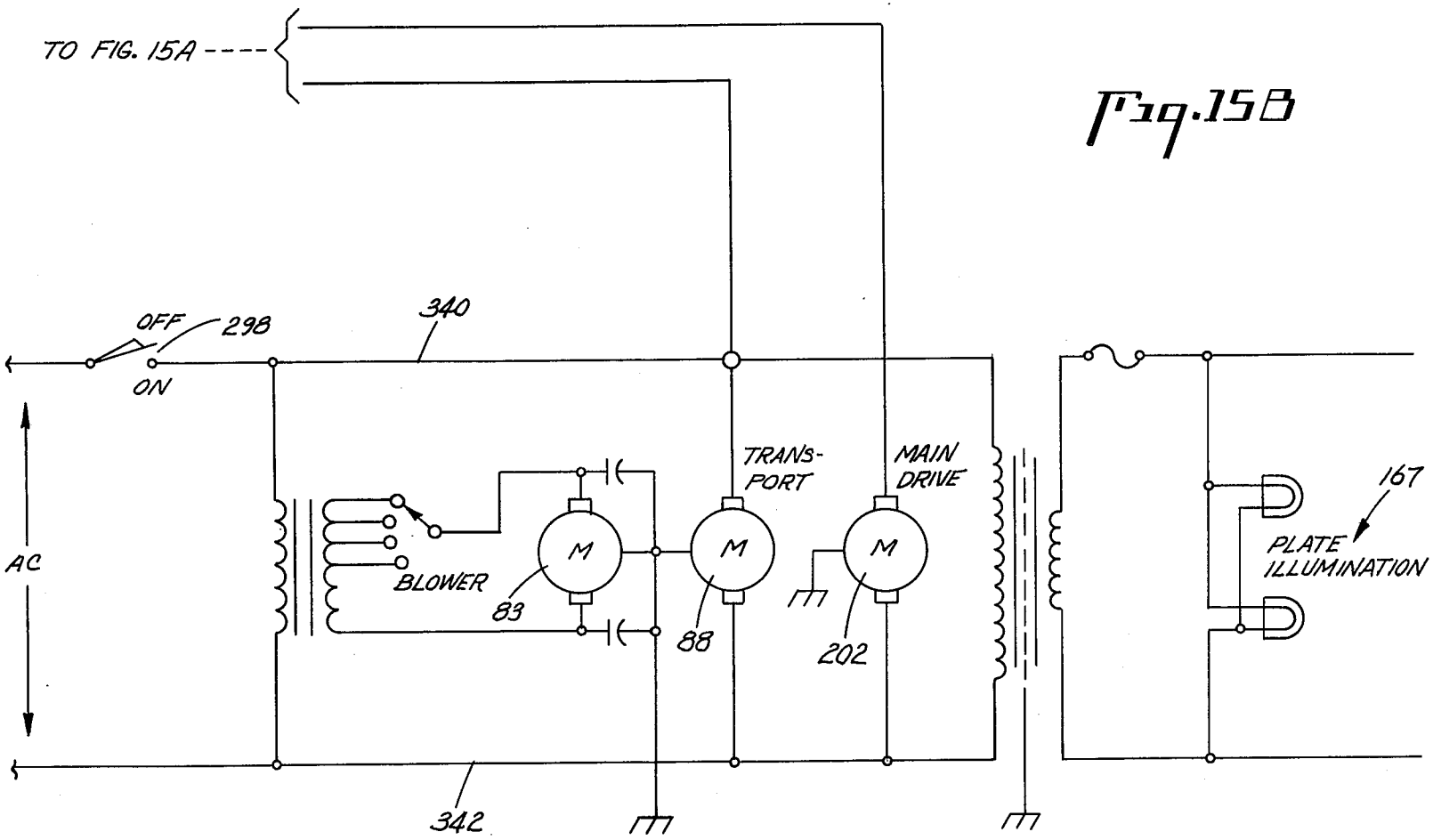
Figure 15C:
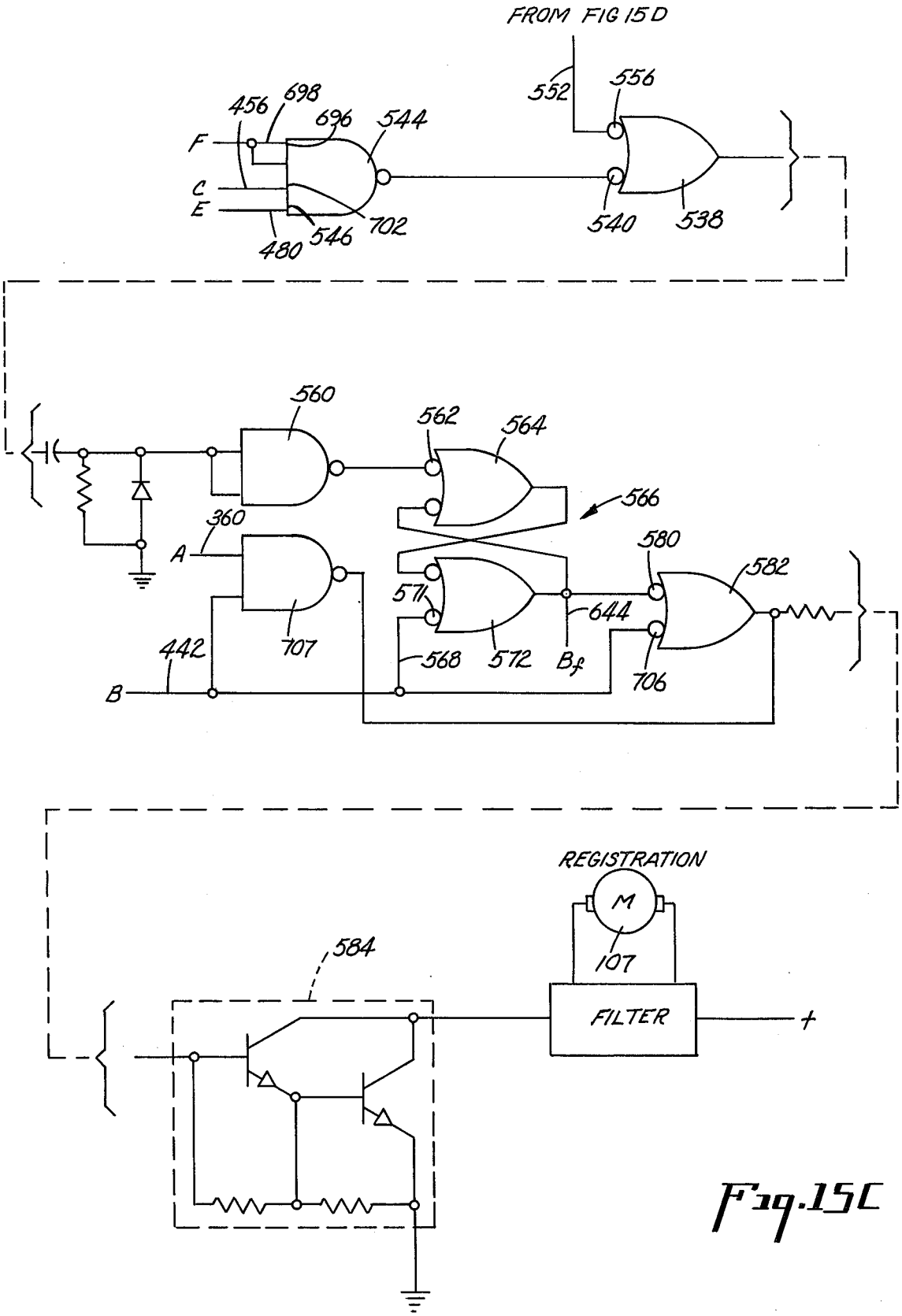

During setting up of the printing apparatus 10, a first envelope 18 must be transferred from the hopper 16 to the printing station. Prior to the transfer of this first envelope, light is transmitted from the lamp 366 to the photocell 364 and a logic one signal is provided on a lead 360 to the terminal 358 of the NAND gate 356 (FIG. 15E). Upon depressing the form feed switch 300 and applying a logic one signal to the terminal 354 of NAND gate 356, a logic zero signal is transmitted to an inverter 374 at an input to an OR gate 376. The resulting logic one output from the OR gate 376 is applied to a pair of inverters connected with an OR gate 380. Thus, depressing the form switch 300 changes the output of the inverter 380 from a logic one to a logic zero. The change in the output of inverter 380 is utilized to set a multivibrator 390 to transmit a negative going signal or pulse for a predetermined time period on an output lead 392 when the logic input to the multivibrator changes from zero to one.

When the form feed switch 300 is released the output of the inverter 380 changes from logic zero to logic one to activate the multivibrator 390 to provide a negative going pulse to an inverter 393 and an amplifier 394. In one specific embodiment of the invention this negative going pulse from the multivibrator 390 had a duration of approximately 140MS. This causes the amplifier 394 to provide a positive going output signal of the same duration on a lead 398. This activates an amplifier 400 to energize the solenoid 56 in the intermittent drive assembly 54 for a period of time equal to the duration of the negative going pulse from the multivibrator 390. As was previously explained, energization of the solenoid 56 activates the intermittent drive assembly 54 to move an envelope into the acceleration nip 78 (FIG. 4) where it is engaged by the continuously rotating drive roller 82 and moved on to the continuously driven conveyor belt 86. Thus, the lead edge of the envelope is moved through a short distance to the acceleration nip 78 and is then moved to the registration nip 100 in the manner illustrated by the curve 401 of FIG. 16.

Figure 13:
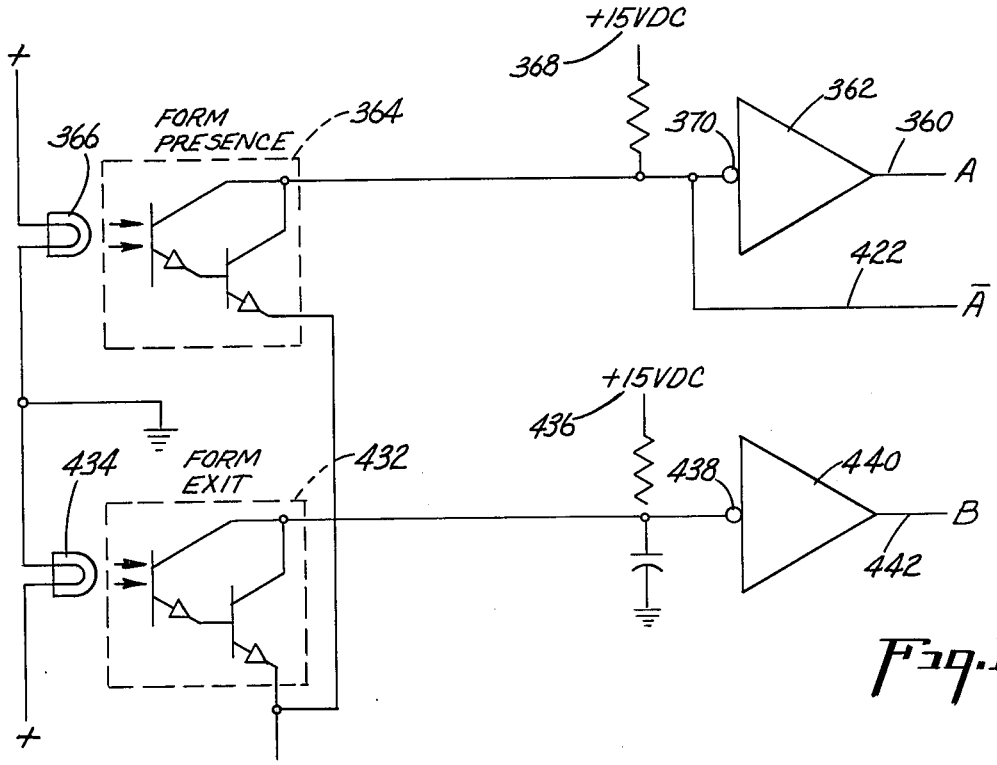
FIGS. 13, 14, 15A, 15B, 15C, 15D and 15E are schematic illustrations of control circuitry.

The conveyor belt 86 transports the envelope in an upright orientation to the printing station 20. When the envelope arrives at the printing station 20, the leading end portion of the envelope engages the registration nip 100 (see FIG. 9) and blocks the transmission of light from the lamp 366 to the photocell 364 (FIG. 13). Therefore, the photocell 364 is rendered non-conducting and the input to the terminal 358 of the NAND gate 356 (see FIG. 15E) changes from logic level one to logic level zero so that further actuation of the form switch 300 is ineffective to activate the intermittent drive assembly 54 to transport a second envelope to the printing station 20.

Once the first envelope to be printed has been transported to the printing station 20, the first printing plate 26 is moved from the drawer 28 to the inspection station 122. This is accomplished by actuating the plate switch 302 (FIGS. 4 and 15A). Actuating the plate feed switch 302 impresses a logic one signal at input 416 of NAND gate 418 and thereby completes control circuit to cause an AC controller 406 to close the circuit which energizes the main drive motor 202 (FIG. 15B) to operate the printing apparatus through one half of an operating cycle. The plate feed mechanism 32 at this time is in a START cycle position as shown in FIG. 7A. With second actuation of the plate feed switch 302 the front plate feed fingers 138 of the plate feed mechanism 32 are moved upwardly through a feed stroke, that is from the position shown in FIG. 7A to the position shown in FIG. 7B, during the first half of an operating cycle of the printing apparatus 10. The third actuation of the plate feedswitch 302 completes the second half of an operating cycle of the printing apparatus 10 and the front plate feed fingers 138 are moved through a return stroke, that is from the position shown in FIG. 7B to the position shown in FIG. 7C. Therefore, when a printing plate is to be moved from the drawer 28 to the inspection station 122, the plate switch 302 must be actuated four times to cycle the machine through a first half of a second operating cycle.

Actuating the plate switch 302 to initiate movement of a first printing plate 26 from the drawer 28 opens a lead 410 (FIG. 15A) and applies a logic one signal from a source 412 to an input terminal 416 of a NAND gate 418. The other terminal 420 of the NAND gate 418 is connected by a lead 422 with the photocell 364 (see FIG. 13). Since the leading end of the envelope which was just transported to the printing station 20 is blocking the transmission of light from the lamp 366 to the photocell 364, a logic one signal is conducted by the lead 422 to the terminal 420 of the NAND gate 418. The logic zero output signal from the NAND gate 418 is conducted to an inverter 426 which is connected to an OR gate 428. A logic one signal is then transmitted from the OR gate 428 to the AC controller 406. This signal effects operation of the AC controller 406 to connect the main drive motor 202 (FIG. 15B) across the two power lines 340 and 342.

Energization of the main drive motor 202 with second actuation of the plate feed switch 302 operates the plate feed mechanism 32 through a first half cycle to move a printing plate from the drawer 28 (FIGS. 5, 7A and 7B) to the intermediate station 140. Upon pressing the plate switch 302 a third time, the main drive motor 202 is again energized to operate the plate feed mechanism 32 through a second half cycle during which the first printing plate remains at the intermediate station 140 and the plate feed mechanism moves into engagement with a next succeeding printing plate in the drawer 28 (FIG. 7C). When the plate switch 302 is activated for a fourth time, the plate feed machinism 32 moves the first printing plate from the intermediate station 140 tc the inspection station 122. The plate switch 302 is then actuated a fifth time to complete the second operating cycle at the end of which the first printing plate is still in the inspection station. At this point the operator decides whether to remain in the manual mode or switch to automatic mode of operation. If he decides to remain in manual mode, then a skip switch is depressed if the plate in the inspection station is not to be printed or a print switch is depressed if it is desired to be printed. In either case the machine cycles through one operating cycle with the exception that the printing assembly is activated only if the print switch was depressed.

Figure 15D:
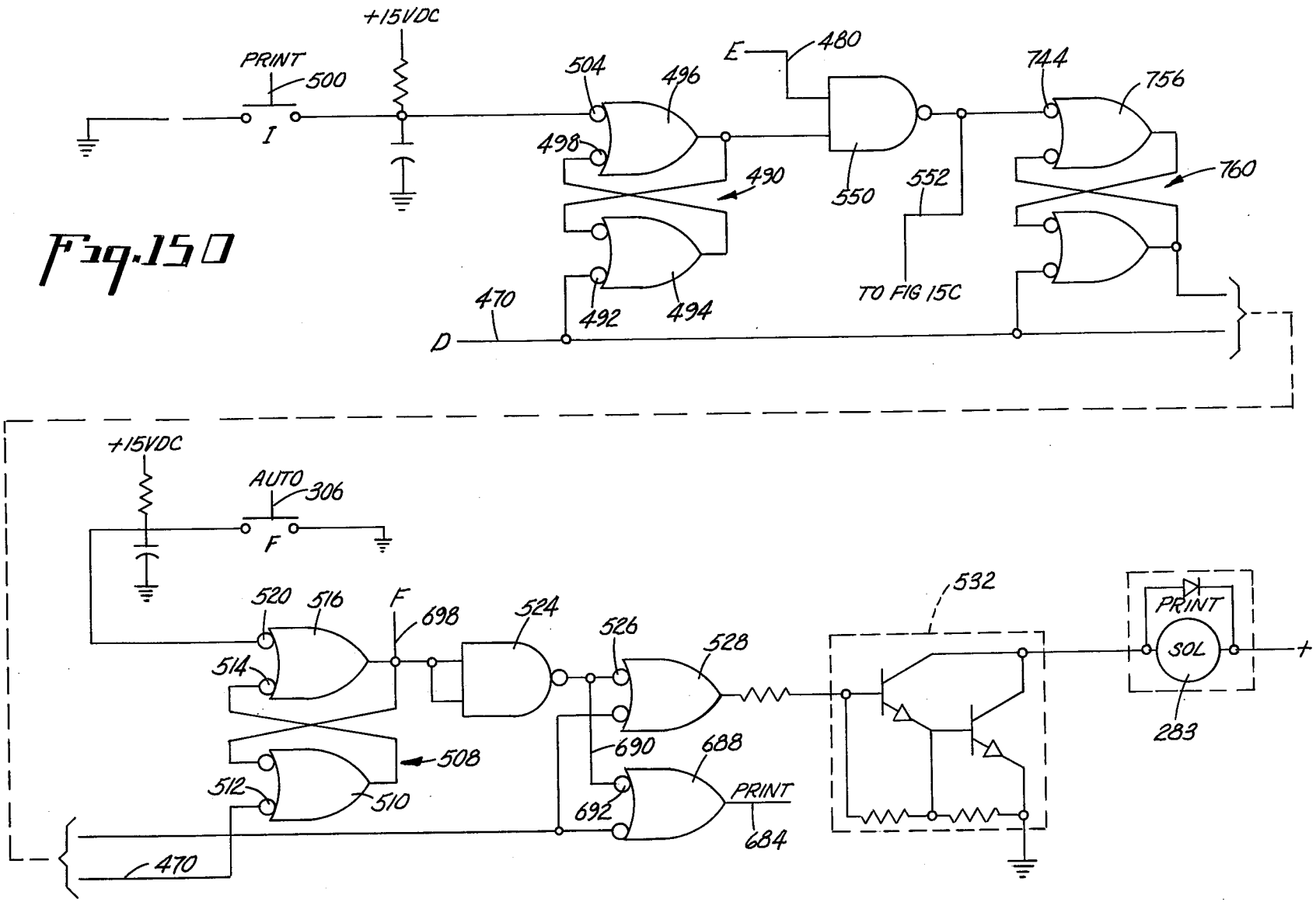
Figure 15E:
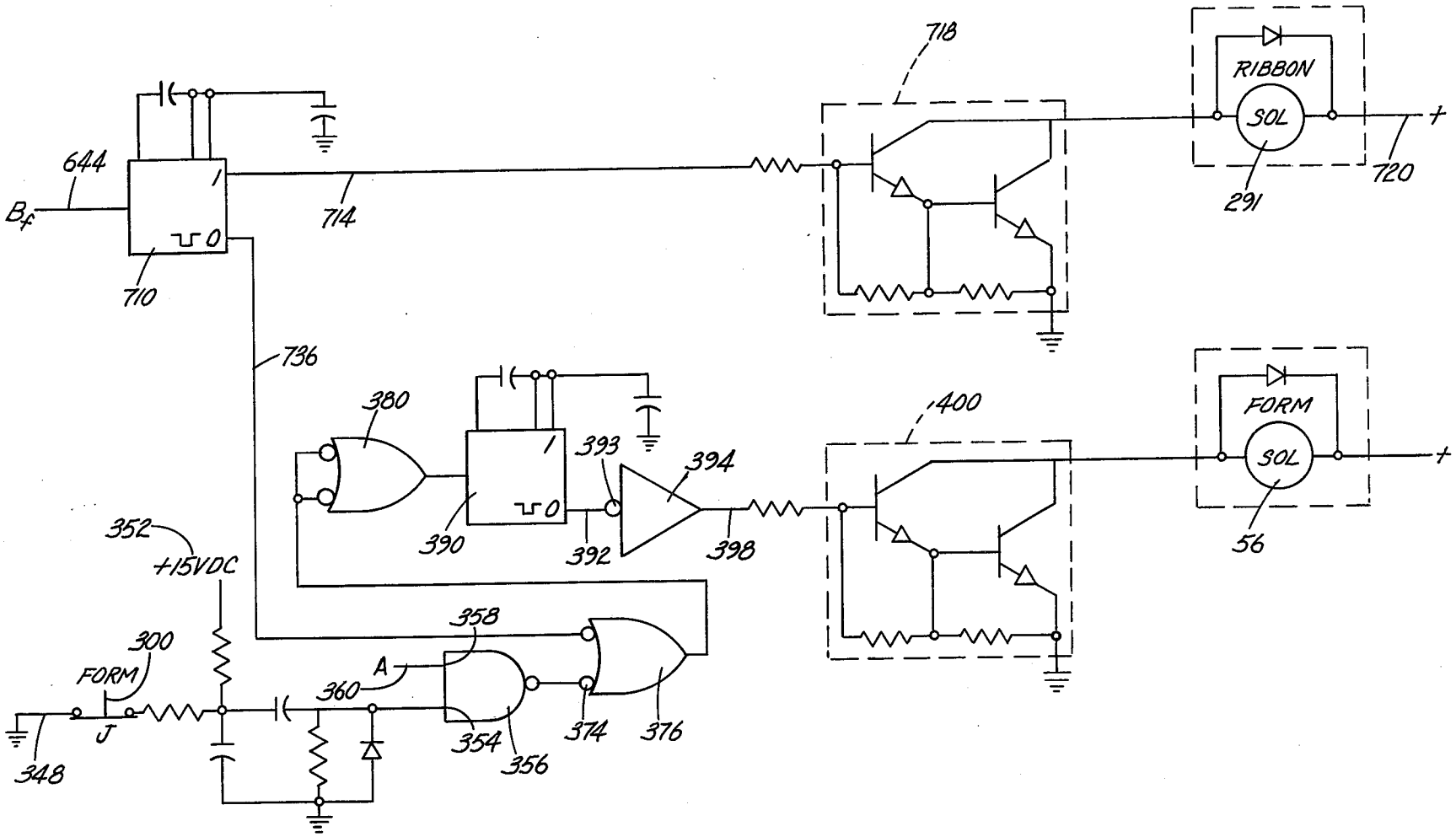

Closing the automatic operation switch 306 FIG. 15D results in the continuous energization of the print solenoid 283. It should be noted that the print solenoid 283 (FIG. 12) remains deenergized during the first five actuations of the plate switch 302 so that the clutch 282 remains disengaged and the drive assembly 278 is ineffective to move the roller platen 262 during setting up of the printing apparatus 10.

In order to determine the sequence of events after depressing the automatic operation switch 306, it is necessary to determine the operational condition of various components of the control circuitry at this time. Upon actuation of the automatic operation switch 306, the input to the invertor 520 (FIG. 15D) is changed from a logic one to a logic zero and the OR gate 516 has a logic one output. The logic one output of the OR gate 516 results in the logic zero output from a inverter 524. The logic zero output from the inverter 524 is transmitted to an inverter 526 connected to the input of an OR gate 528. This results in an amplifier 532 being rendered conducting to thereby effect energization of the print solenoid 283.

As previously explained, energization of the print solenoid 283 (FIG. 12) moves an arm 284 out of the way of a clutch actuator lever 285 so that the clutch 282 is engaged during rotation of the shaft 286. It should be noted that the crank arm 281 is in position such that the cable 280 is relaxed and the roller platen is moved to the beginning of print position under the influence of the return spring 287 (FIG. 4). Therefore, energization of the print solenoid 283 moves the arm 284 out of the way of the clutch actuator lever 285 so that during the next half of a revolution of the shaft 286 under the influence the main drive motor 202, the roller platen 262 is moved through a printing stroke.

Upon actuation of the automatic operation switch 306, the registration motor 107 (FIG. 11) is not energized and the first envelope remains at the printing station 20. This is because an OR gate 538 (FIG. 15C) has a logic zero output upon actuation of the automatic operation switch 306.

The logic zero output from the inverter 524 is transmitted to an inverter 692 connected to the input of an OR gate 688 (FIG. 15D) and as correspondence logic one signal appears on line 684 (called PRINT in FIG. 15D) which is connected to the input of a NAND gate 652 in FIG. 15A. The other input of the NAND gate 652 is connected to the start cycle switch. Because the machine is in the start cycle position at the end of five actuations of plate feed switch 302, the line 480 has a logic one signal on it. Therefore the output of NAND gate 652 is logic zero. The output of NAND gate is 652 connected to the inverter 654 which is connected to the OR gate 428. The logic one signal from the OR gate 428 is transmitted to the AC controller 406. This signal effects operation of AC controller 406 to connect the main drive motor 202 (FIG. 15B) across the two power lines 340 and 342. After the shaft 286 (FIG. 4) of the main drive motor rotates about 25°, the start cycle switch opens up and the logic one signal is passed on to line 482. Because the shaft has only rotated 25°, the midcycle switch is still open, thus a logic one signal exists on line 470. Both the lines 470 and 482 carrying logic one signals are connected to the NAND gate 660 in FIG. 15A. The zero output of the NAND gate 660 is connected to the inverter 662 which in turn is connected to the OR gate 428. The logic one signal emitted by 428 activtes AC controller and the main drive motor continues running. When the shaft 286 has rotated by 180°, the midcycle switch closes and hence logic zero appears on line 470. The output of NAND gate 660 goes to one and the main drive motor no longer has its energization signalled by the output of NAND gate 660. At this point a midcycle check is conducted.

Referring to FIG. 13, the first envelope is blocking the transmission of light from the lamp 366 to the photocell 364. Therefore a logic one signal is transmitted over the lead 422 while a logic zero signal is transmitted over the lead 360.

In addition to the photocell 364 and lamp 366 which detect the presence of an envelope at the printing station 20, a second photocell 432 (FIG. 13) is associated with a second lamp 434 mounted in the assembly 106 on the downstream or exit side of the registration nip 100 (FIG. 10). Since an envelope is not blocking the transmission of light from the lamp 434 to the photocell 432, a 15-Volt DC source 436 is connected directly to ground through the photocell 432 and logic zero signal is applied to an inverter 438. This results in the transmission of a logic one signal from an amplifier 440 to a conductor 442.

A plate detection or plate presence switch 448 (FIG. 14) is disposed adjacent to the printing station 20. The switch 448 is closed when a printing plate is present at the printing station 20 and is open when a printing plate is not present at the printing station. Since the first printing plate 26 was moved to the printing station 20 during setting up of the printing apparatus 10, the switch 448 is closed. Therefore, a logic zero signal is applied to an inverter 452. A logic signal is applied by an amplifier 454 to an output line 456.

Figure 14:
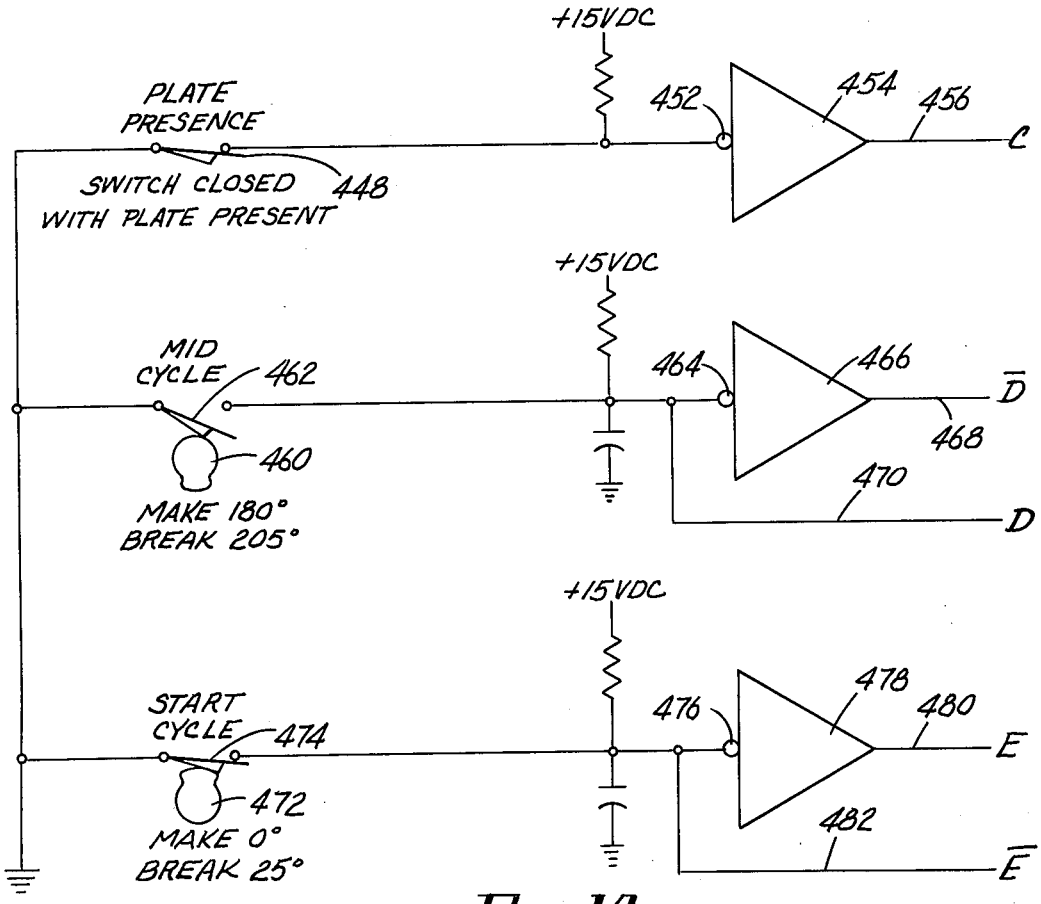

The condition detecting apparatus of FIGS. 13 and 14 determine the settings of sub-circuits within the control circuitry of FIGS. 15C and 15D. Thus, a mid-cycle print flip-flop 490 (FIG. 15D) is set by the logic zero signal which is transmitted over the lead 470 to an inverter 492 connected to the input of an OR gate 494. The resulting logic one signal from the output of the OR gate 494 is applied to a second OR gate 496 through an inverter 498. At this time, the print switch 500 is open so that a logic one signal is applied to an inverter 504 connected to the other input of the OR gate 496. Therefore, a logic zero output signal is transmitted from the OR gate 496.

A second flip-flop 508 (FIG. 15D) is also set by the signal transmitted on the line 470 from the mid-cycle switch 462 (FIG. 14) prior to closing of the automatic operation switch 306. Thus at mid-cycle, the switch 462 is closed and a logic zero is applied to the lead 470 and OR gate 510 in the flip-flop 508 receives a logic one input from an inverter 512. The logic one output signal from the OR gate 510 is transmitted to an inverter 514 which is connected to the input of a second OR gate 516. Prior to the actuation of the automatic operation switch 306, a logic one signal is applied to an inverter 520 connected to a second input of the OR 516 so that the OR gate will have a logic zero output.

Upon actuation of the automatic operation switch 306, the input to the inverter 520 (FIG. 15D) is changed from a logic one to a logic zero and the OR gate 516 has a logic one output. The logic one output of the OR gate 516 results in the logic zero output from an inverter 524. The logic zero output from the inverter 524 is transmitted to an inverter 526 connected to the input of an OR gate 528. This results in a amplifier 532 being rendered conducting to thereby effect energization of the print solenoid 283.

As previously explained, energization of the print solenoid 283 (FIG. 12) moves an arm 284 out of the way of a clutch actuator lever 285 so that the clutch 282 is engaged during rotation of the shaft 286. It should be noted that the crank arm 281 is in position such that the cable 280 is relaxed and the roller platen is moved to the beginning of print position under the influence of the return spring 287 (FIG. 4). Therefore, energization of the print solenoid 283 moves the arm 284 out of the way of the clutch actuator lever 285 so that during the next half of a revolution of the shaft 286 under the influence the main drive motor 202, the roller platen 262 is moved through a printing stroke.

Upon actuation of the automatic operation switch 306, the registration motor 107 (FIG. 11) is not energized and the first envelope remains at the printing station 20. This is because an OR gate 538 (FIG. 15C) has a logic zero output upon actuation of the automatic operation switch 306. At this time, an inverter 540 connected to one input of the OR gate 538 receives a logic one signal from a NAND gate 544. The NAND gate 544 has a logic one output because a logic zero input is applied to a terminal 702. In addition the inverter 556 connected to the other input of the OR gate 538 is receiving a logic one signal on conductor 552 from the output of NAND gate 550 whose output is a logic one signal since the output of OR gate 496 is a logic zero signal as heretofore noted.

The logic zero output from the OR gate 538 does not initiate energization of the registration motor 107 (FIG. 15C) deenergized upon actuation of the automatic operation switch 306 as will be seen from the following. The differentiated output of the OR gate 538 is transmitted to a inverter 560. The resulting logic one output signal from the inverter 560 is conducted to an inverter 562 connected to an OR gate 564 in a flip-flop 566. A set lead 568 to the flip-flop 566 is connected with the lead 442 which is connected with the inverter 438 and amplifier 440 (FIG. 13). Therefore, a logic one input is applied to an OR gate 572 in the flip-flop (FIG. 15C). The flip-flop 566 will have previously been set to a logic one output during initial operation of the printing apparatus 10. Therefore, the flip-flop 566 will have a logic one output which is connected to an inverter 580 to an OR gate 582. The logic zero output from the OR gate 582 results in an amplifier 584 being non-conducting so that the registration motor 107 remains deenergized upon initial actuation of the automatic operation switch 306.

During the first half of the third cycle of operation of the printing apparatus 10, a printing plate detection flip-flop 590 (FIG. 15A) is set. Thus, upon initiation of the third operating cycle, a logic zero input is received over the lead 482 since the start-cycle switch 474 is closed (FIG. 14). The zero signal on the lead 482 is applied to an inverter 594 connected to the input of an OR gate 596. The OR gate 596 will then have a logic one output to an inverter 600 connected to the input of an OR gate 604. Upon initiation of the third operating cycle, a printing plate will not have been moved to the printing station 20. Therefore, the plate present switch 448 (FIG. 14) is open and a logic zero signal is applied to the lead 456 connected to an inverter 608 (FIG. 15A) and the input to the OR gate 604. Therefore, the OR gate 604 and flip-flop 590 will have a logic one output at this time.

As the first half of the third operating cycle of the printing apparatus 10 proceeds, the cam 472 (FIG. 14) is rotated and the start-cycle switch 474 opens. This causes the signal on the lead 482 to shift from a logic zero to a logic one. The OR gate 596 (FIG. 15A) will have a logic zero output to the inverter 600. Upon the subsequent arrival of the first printing plate to the printing station 20, the logic signal on lead 456 shifts to a logic one. However, this will not change the output of the flip-flop 590 which will remain at a logic one level.

A mid-cycle check is initiated by the control circuitry to determine if a previously printed envelope 18 has exited from the printing station 20 and a succeeding envelope to be printed is located at the printing station. In addition, the mid-cycle check determines if the previously utilized printing plate 26 has been moved from the printing station 20 to the drawer 28 and a next succeeding printing plate moved to the printing station. If the mid-cycle check does not indicate that the envelopes 18 and printing plate 26 have been properly fed to and from the printing station 20, the main drive motor 202 is deenergized to stop operation of the printing apparatus 10.

The mid-cycle check results from interaction between a NAND gate 614 (FIG. 15A) and the inverted input OR gate 428. If the previously printed envelope has fully exited from the printing apparatus 10, a logic one input is applied to a terminal 618 of the NAND gate 614 over lead 442 which is connected with the form exit detection apparatus of FIG. 13. Since the mid-cycle switch 462 (FIG. 14) is closed, a logic one signal is applied to the lead 468 and a terminal 622 of the NAND gate 614. Similarly, a logic one signal is applied to the terminal 624 of the NAND gate 614 over the lead 422 since an envelope is present at the printing station 20 (FIG. 13).

The presence of a printing plate at the printing station 20 results in the transmission of logic one signals over leads 456 and 630 to a terminal 634 of the NAND gate 614. The logic one ouput of the flip-flop 590 established in the first half of the cycle is described above, is applied to a terminal 636 of the NAND gate 614. The terminal 640 of the NAND gate 614 is connected by the lead 644 to the output flip-flop 566 (FIG. 15C). Since the output of flip-flop 566 is, at this time logic one, a logic one signal is applied to all the terminals on the NAND gate 614.

When all of the inputs to the NAND gate 614 are at logic one, this indicates that the envelopes 18 and printing plates 26 have been properly fed to and from the printing station 20. The resulting logic zero output from the NAND gate 614 is applied to an inverter 648 (FIG. 15A) connected to the OR gate 428. This results in the AC controller 406 being activated to energize the main drive motor 202 (FIG. 15B) in the manner previously explained to continue with the last half of the third operating cycle of the printed apparatus 10.

If one of the conditions which were checked was not in the proper order, a logic zero signal would be applied to one of the terminals of the NAND gate 614 (FIG. 15A). This would result in a logic one signal being applied to the inverter 648 so that the OR gate 428 would not activate the AC controller 406 by reason of the signal being received from the NAND gate 614. The status of the other inputs to OR gate 428 are discussed in detail below. At this time, the front and rear plate feed fingers 138 and 144 are in approximately the position shown in FIG. 7B and are clear of the drawer 28. Therefore if it is necessary, the drawer 28 can be readily removed.

It should be noted that when the mid-cycle check is conducted the other inputs to the inverters connected to the OR gate 428 receive logic one signals so that these signals are ineffective to activate the OR gate 428. Thus at mid-cycle, the NAND gate 418 (FIG. 15A) has a logic one output signal since the plate switch 302 and skip switch 304 are closed and a logic zero signal is applied to the terminal 416 of the NAND gate 418. A NAND gate 652 is also connected to the OR gate 428 through an inverter 654. At mid-cycle the NAND gate 652 has a logic one output since the terminal 656 is connected by the lead 480 with the apparatus for detecting the start of a cycle (FIG. 14). Similarly, NAND gate 660 has a logic one output to an inverter 662 since a terminal 664 is connected by a lead 470 with a now closed mid-cycle switch 462 (FIG. 14).

Assuming that the mid-cycle check indicated that all of the systems in the printing apparatus 10 were functioning properly, the main drive motor 202 will initiate operation of the printing assembly 260 to print on an envelope with a printing plate 26 at the printing station 20. At the same time, the plate feed mechanism 32 begins to move through a return stroke. After approximtely 25° of rotation of the mid-cycle cam 460, the mid-cycle switch 462 opens (FIG. 14). Of course, opening the mid-cycle switch 462 results in a logic zero signal being transmitted to the terminal 622 of the NAND gate 614 (FIG. 15A) over the lead 468. Therefore upon opening of the mid-cycle switch 462, the output from the NAND gate 614 shifts from a logic zero signal to a logic one signal and the OR gate 428 is no longer activated by the output signal from the NAND gate 614. However, the signal conducted over the lead 470 (FIG. 14) will shift from a logic zero to a logic one so that the input to the terminal 664 of the NAND gate 660 (FIG. 15A) will shift to a logic one. Since the start-cycle switch 474 is now open, the input on the lead 482 is also a logic one and the output from the NAND gate 660 shifts from a logic one to a logic zero. This enables the OR gate 428 to maintain the main drive motor 202 energized throughout the second half of the third operating cycle of the printing apparatus 10.

Figure 16:
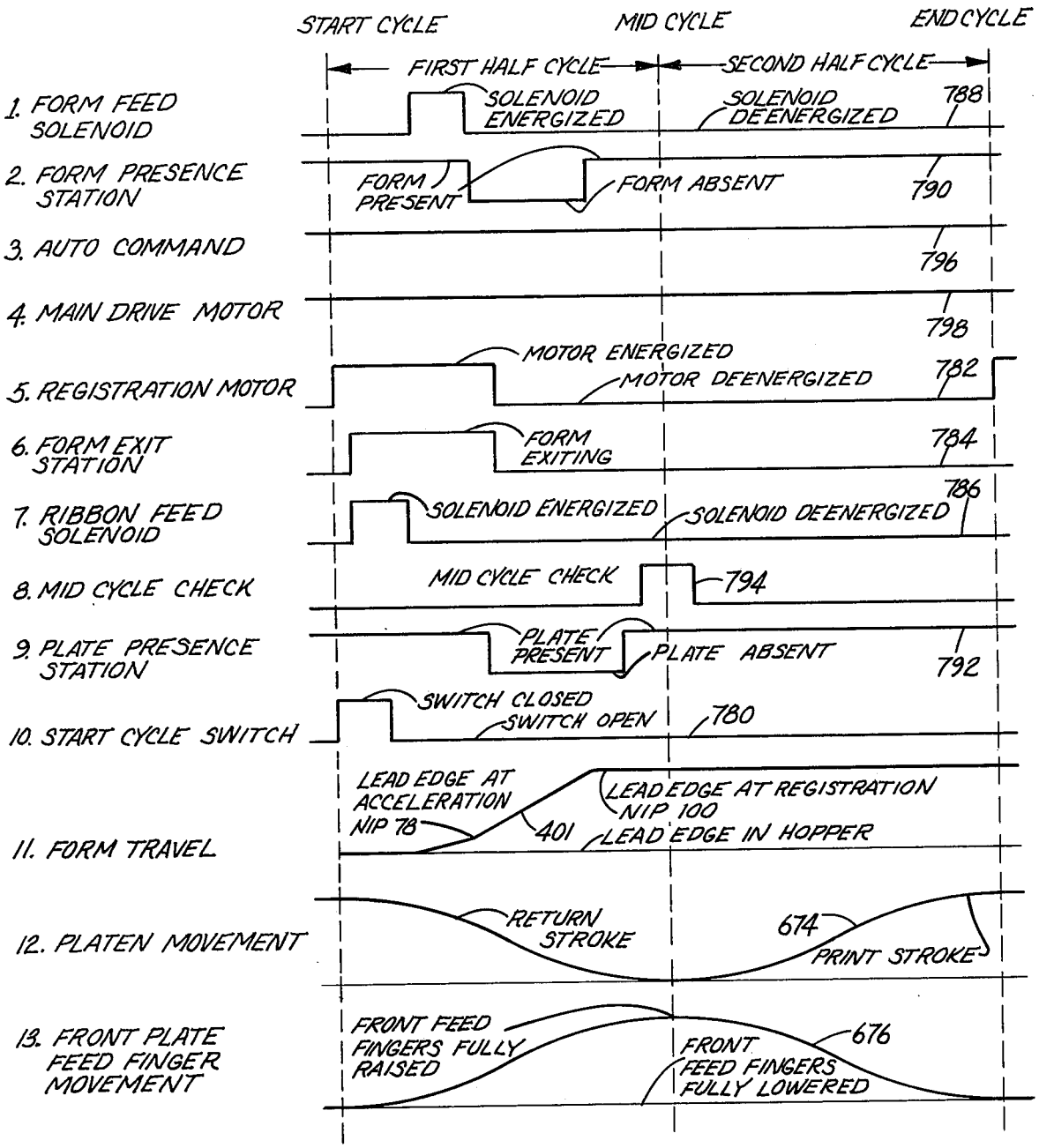
FIG. 16 is a timing diagram.

During the second half of the operating cycle, the roller platen 262 moves through a printing stroke, as indicated by the curve 674 in FIG. 16. At the same time, the plate feed mechanism 32 will be operated through a return stroke to lower the front plate feed fingers into engagement with the next succeeding printing plate in the drawer 28 in the manner illustrated by the curve 676 in FIG. 16.

Upon completion of the second half of the third operating cycle, the start-cycle cam 472 (FIG. 14) closes the start-cycle switch 474 to change the signal on the lead 482 from a logic one to a logic zero to change the output of the NAND gate 660 (FIG. 15A) from a logic zero to a logic one. Therefore, the NAND gate 660 will no longer be effective to maintain the logic one output from the OR gate 428. However since the automatic operation switch 306 has been actuated, the next succeeding cycle of operation of the printing apparatus 10 is automatically undertaken.

To prevent the output from the OR gate 428 from shifting from a logic one to a logic zero upon completion of a cycle, the output of the NAND gate 652 shifts from a logic one to a logic zero upon the completion of one cycle and the starting of the next cycle. This is because the input signal to the terminal 656 over the lead 480 will change from a logic zero to a logic one upon a closing of the start-cycle switch 474 (FIG. 14). The second terminal 680 of the NAND gate 652 is connected by a lead 684 with the output of an OR gate 688 (FIG. 15D). When the automatic operation switch 306 is actuated, the output of the OR gate 688 is a logic one. This is because the input to the inverter 520 remains at logic zero so that the OR gate 516 has a logic one output and the inverter 524 has a logic zero output which is connected by a lead 690 to an inverter 692 which is connected directly to the OR gate 688. Thus, during automatic operation of the printing apparatus 10, logic one signals are applied to the terminals 656 and 680 of the NAND gate 652 upon the completion of one operating cycle and the initiation of the next succeeding operating cycle.

Upon a starting of the next succeeding operating cycle, the previously printed envelope is discharged from the printing apparatus 10 to the receiving tray 36. To accomplish this it is necessary to energize the motor 107 (FIGS. 15C and 11) to drive the roller 102 and move the printed envelope away from the printing station 20. The motor 107 is energized in response to a shift in the output of NAND gate 544 (FIG. 15C) from a logic one to a logic zero. The NAND gate 544 has a terminal 696 to which a logic one input is always applied over a lead 698 during automatic operation of the printing apparatus 10. This is because the lead 698 is connected with the output of the OR gate 516 (see FIG. 15D). The printing plate which was utilized during the immediately succeeding operating cycle of the printing apparatus 10 will still be at the printing station 20. Therefore, the plate presence switch 448 is closed (FIG. 14) and a logic one signal is applied to a lead 456 which is connected to a terminal 702 of the NAND gate 544 (FIG. 15C). Since the start-cycle switch 474 (see FIG. 14) is closed upon initiation of the new operating cycle, a logic one signal is transmitted over a lead 480 to the terminal 546 (FIG. 15C) of the NAND gate 544.

Upon the initiation of a new operating cycle with the automatic operation switch 306 actuated, the NAND gate 544 has a logic zero output which results in a logic one output from the OR gate 538. The inverter 560 will then have the logic zero output to the inverter 562 and will reset the flip-flop 566. This results in a logic one output signal from the OR gate 582 so that the registration motor 107 is activated. It should be noted that the flip-flop 566 will maintain a logic zero output even though the start cycle switch 474 (FIG. 14) is opened and the output of the NAND gate 544 (FIG. 15C) shifts from a logic zero to a logic one.

The registration motor 107 is maintained energized until the photocell 432 (FIG. 13) detects that the previously printed envelope has been completely removed from the printing station 20. Thus, as the previously printed envelope passes through the registration nip 100 (FIG. 9) it moves between the lamp 434 (FIG. 7) and the photocell 432. This renders the photocell 432 (FIG. 13) non-conducting so that a logic zero signal is applied to the lead 442. The lead 442 is connected to the flip-flop 566 (FIG. 15C) and sets it. However, the lead 442 is also connected with an inverter 706 which is connected directly to the OR gate 582. Therefore, the logic one output from the OR gate 582 is maintained by the logic zero input signal on the line 442 until the previously printed form has completely exited from the printing apparatus 10. When this happens, the trailing end portion of the printed envelope moves out from between the lamp 434 and photocell 432. The signal on line 442 then shifts from a logic zero to a logic one and the output from the OR gate 582 shifts from a logic one to a logic zero. The amplifier 584 is then rendered non-conducting and the registration motor 107 is deenergized. A NAND gate 707 (FIG. 15C) has a logic zero output when there is a form absent condition both at the printing station 20 and between the exit lamp 434 and photocell 432. This output is combined with the output of the OR gate 582 in a wired AND configuration which requires that both outputs must be logic one in order to impress a voltage capable of rendering the amplifier 584 conducting. Thus the motor 107 will be allowed to run only when an envelope is blocking at least one of the sensors, 364, 462, and cannot be tripped to operate unnecessarily in response to a spurious signal.

Upon initiation of the feeding of the previously addressed envelope from the printing apparatus 10, the ribbon feed solenoid 291 (FIGS. 4 and 15E) is energized to index the ribbon 274 relative to the printing station 20. The solenoid 291 is energized for a predetermined period of time, for example 70MS, upon a firing of multivibrator 710 (FIG. 15E). The multivibrator 710 normally has a logic zero output on a lead 714. However, upon a shift in the logic output of the flip-flop 566 from one to zero upon initiation of an operating cycle, the multivibrator 710 is armed by a logic zero signal which is conducted from the output of the flip-flop 566 by a lead 644 (FIG. 15C) to the multivibrator 710 (FIG. 15E). When the output of the flip-flop 566 shifts to a logic one in response to movement of the leading end of the previously printed envelope between the lamp 434 and photocell 432 (FIG. 13) and a shift in the signal on the lead 442 from one to zero (see FIG. 15C), the multivibrator 710 is fired to provide a positive going signal on the lead 714 of sufficient duration to operate the solenoid 291 and index the ribbon 274. This positive going signal on the lead 714 renders the amplifier 718 conducting so that a positive source connected to the solenoid 291 by a lead 720 is connected with ground through the amplifier 718. At the end of the predetermined time period, the positive going or logic one output signal from the multivibrator 710 again shifts to the logic zero signal and the amplifier 718 is again rendered non-conducting so that the solenoid 291 is deenergized.

After operation of printing apparatus 10 for a relatively long period of time, it is contemplated that the ribbon supply spool 292 (FIG. 4) may be emptied. When this occurs, a pair of ribbon out contacts 724 (FIG. 15A) are closed connecting a positive voltage source 726 with ground and energizing a ribbon out lamp 728. The closing of the ribbon out contact 724 maintains logic zero signal on a lead 730. The flip-flop 590 then has a logic zero output and operation of the printing apparatus 10 will be interrupted the next time a mid-cycle check is conducted.

During the first half of this cycle of operation of the printing apparatus 10, the envelope to be addressed is transferred from the hopper 16 (FIG. 4) to the printing station 20. To accomplish this, it is necessary to activate the intermittent drive assembly 54 (FIGS. 4 and 8). However, before feeding of the envelope from the supply hopper 16 is initiated, it is necessary to have at least undertaken a feeding of the previously printed envelope from the printing station 20 to the receiving tray 36. To insure that this occurs, the solenoid 56 in the intermittent drive assembly 54 is energized in response to operation of the multivibrator 710 (FIG. 15E) which is itself activated in response to movement of the leading end portion of a printed envelope through the registration nip 100 (FIG. 9) into the space between the lamp 434 and photocell 432 (FIG. 13).

Upon activation of the multivibrator 710 to provide a positive going or logic one signal on the lead 714 (FIG. 15E) a negative going or logic zero signal is applied to a lead 736. This logic signal has a duration which is equal to the duration of the logic one signal applied to lead 714, in one preferred embodiment of the invention this time duration was 70MS. The relative short logic zero signal on the lead 736 results in a logic one signal being transmitted from the OR gate 376 to the inverter 380 (FIG. 15E). The logic zero output from the inverter 380 arms the multivibrator 390.

After the predetermined time period has passed and the signal on lead 736 shifts from a logic zero to a logic one, the output of the inverter 380 shifts from logic zero to logic one. This causes the multivibrator 390 to apply a negative going or logic zero signal to the lead 392. This signal is inverted and transmitted by an amplifier 394 as a logic one signal to a lead 398 connected with the amplifier 400 (FIG. 15E). This logic one signal renders the amplifier 400 conducting so that the form feed solenoid 56 is energized in the manner previously explained. After a predetermined time period has passed (in the illustrated embodiment of the invention this time period was 140MS) the logic zero signal on the lead 392 is shifted to a logic one signal so that the amplifier 400 is shut off and the solenoid 56 is deenergized.

As was previously explained in connection with the operation of the form switch 300, energization of the solenoid 56 for a relatively short period of time is enough to activate the intermittent drive assembly 54 (FIGS. 4 and 8) to feed an envelope from the hopper 16 onto the conveyor belt 86. The conveyor belt 86 transports the envelope in an upright orientation to the printing station 20. It should be noted that the registration motor 107 (FIGS. 11 and 15C) drives the roller 102 (FIG. 11) at a relatively high speed so that the previously printed envelope is moved away from the printing station 20 at a higher speed than the next succeeding envelope is moved to the printing station by the conveyor belt 86. Therefore, the previously printed envelope will have moved away from the printing station and the motor 107 will have been de-energized before the next succeeding envelope moves into engagement with the registration nip 100 and is positioned relative to the printing station 20.

During the first half of an operating cycle of the printing apparatus 10, the rear plate feed assembly 126 of the plate feed mechanism 32 is operated from the raised condition shown in FIG. 7A to the lowered condition shown in FIG. 7B to move the printing plate **26*d* which was utilized during the previous printing cycle from the printing station 20 back into the drawer 28. While the previously utilized printing plate 26*d* is being returned to the drawer 28, the next succeeding printing plate 26*c* is moved from the inspection station 122 to the printing station 20. It should be noted that the next succeeding printing plate, that is the printing plate 26*c* of FIG. 7A, arrives at the printing station 20 a short time after the previous printing plate, that is the printing plate 26*d* of FIG. 7A, has been moved away from the printing station. This results in the plate detection switch 448 (FIG. 14**) being operated from a closed condition to an open condition and then back to the closed condition.

If for some unforeseen reason the plate feed mechanism 32 should malfunction and fail to move the previously utilized printing plate away from the printing station 20, a jam up would occur when the next succeeding plate was moved to the printing station 20. If the printing assembly 260 was operated with two printing plates at the printing station 20, the printing apparatus 10 could be damaged. Accordingly, the control circuitry will interrupt operation of the printing apparatus 10 at the mid-cycle check if the previously utilized printing plate is not moved away from the printing station prior to arrival of the next succeeding printing plate at the printing station.

The control circuitry detects the proper movement of printing plates 26 to and from the printing station by detecting the absence of a printing plate at the printing station between movement of the previously used printing plate from the printing station and the arrival of the next succeeding printing plate at the printing station. The signal resulting from the opening of the switch 448 during the absence of a printing plate at the printing station 20 is utilized to set the flip-flop 590 (FIG. 15A). The flip flop 590 is set by applying a logic zero signal to the lead 456.

At the start of a printing cycle, the previously utilized printing plate is present at the printing station 20 and the plate present switch 448 (FIG. 14) is closed so that a logic one signal is present on the lead 456. At this time, a logic zero signal is conducted over the lead 482 to the OR gate 596 (FIG. 15A) since the start cycle switch 474 (FIG. 14) is closed. Therefore, the OR gate 604 (FIG. 15A) has a logic zero output. Upon movement of the previously utilized printing plate 26 away from the printing station 20 due to operation of the plate feed mechanism 32, the plate present switch 448 opens and a logic zero signal will be applied to the lead 456 to set the flip-flop 590 to a logic one output which is maintained until the mid-cycle check occurs. If the previously utilized printing plate was not removed from the printing station 20 the flip-flop 590 would not be set and would have a logic zero output. Of course, this would result in stopping of the printing apparatus 10 at the next mid-cycle check in the manner previously explained.

After the envelope and printing plate which are to be utilized during this cycle of operation of the printing apparatus 10 have been moved to the printing station 20, the mid-cycle check is conducted in the manner previously explained. The time sequence relationship of the various operations of the printing apparatus 10 is illustrated schematically in FIG. 16. A printing cycle is initiated by actuation of the start cycle switch 474 in the manner depicted schematically by the curve 780 in FIG. 16. This results in activation of the registration motor 107 as shown by curve 782 and exiting of a previously printed envelope between the lamp 434 and photocell 432 as represented by the curve 784. Contemporaneously therewith the ribbon solenoid 291 is energized to index the ribbon 274 as represented by the curve 786.

After the start-cycle switch has opened and the previously printed envelope has started to exit, the solenoid 56 is energized to initiate the feeding of a next succeeding envelope as represented by the curve 788. Shortly after the solenoid 56 is energized the previously printed envelope leaves the printing station 20. A short time thereafter the next suceeding envelope arrives at the printing station in the manner indicated by the curve 790.

While the envelopes are being fed to and from the printing station, printing plates are also fed to and from the printing station as represented by the curve 792. It should be noted that a printing plate is not present at the printing station for a short time to enable the flip-flop 590 to be set. The mid-cycle check is then undertaken as represented by curve 794 and the roller platen 262 starts to move through a print stroke, as represented by curve 674 in FIG. 16.

If it is desired not to print the particular plate in the inspection station 122, a skip switch 304 on the control panel 52 is depressed. Upon actuation of the skip switch, the machine cycles through one operating cycle and brings the next plate in the inspection station as previously explained.

It is contemplated that under certain operating conditions it may be desired to print on one envelope with a particular one of the printing plates without utilizing other printing plates. When the desired printing plate is moved to the inspection station 122, the print switch 500 is depressed and the printing apparatus 10 is operated through a single operating cycle during which the desired printing plate is moved to the printing station 20, the previously printed form is discharged from the printing apparatus 10, and a next succeeding envelope is moved to the printing station 20. During the last half of this cycle the printing assembly 260 is operated to print on the new envelope with the desired printing plate.

Upon actuation of the print switch 500 the input to the flip-flop 490 (FIG. 15D) at the inverter 504 is changed from a logic one to a logic zero so that the output of the flip-flop 490 changes from a logic zero to a logic one. Since this is the beginning of a new cycle and the start-cycle switch 474 is closed (FIG. 14), a logic one signal would appear on the lead 480 and the NAND gate 550 (FIG. 15D) has a logic zero output. This is transmitted by the lead 552 to the OR gate 538 (FIG. 15C). The OR gate 538 will then have a logic one output to the inverter 560. The logic zero output from the inverter 560 resets the flip-flop 566 to a logic zero output. The logic zero output from the flip-flop 566 results in the transmission of a logic one output from the OR gate 582 to render the amplifier 584 conducting so that the registration motor 107 is energized and the previously printed envelope is discharged from the printing apparatus 10 in the manner previously explained.

As the previously printed envelope is discharged from the printing apparatus 10, the signal on the lead 442 shifts from a logic one to a logic zero to set the flip-flop 566 and maintain the registration motor 107 in an energized condition. The setting and resetting of the flip-flop 566 results in operation of the multivibrator 710 to energize the ribbon solenoid 291 and in operation of the multivibrator 390 to energize the form solenoid 56 in the intermittent drive assembly 54. Since the manner in which this occurs was previously explained in connection with the automatic operation of the printing apparatus 10, it will not be repeated at this time in order to avoid prolixity of description.

Actuation of the print button also results in energization of the print solenoid 283 (FIG. 15D). Thus, the logic zero signal from the NAND gate 550 is transmitted to an inverter 744 connected to an OR gate 756 of flip-flop 760. Since the mid-cycle switch 462 is open at this time, the flip-flop 760 has a logic zero output which is connected to the OR gate 528 to effect energization of the print solenoid 283. Since the output of the NAND gate 550 shifts from logic zero to logic one when the mid-cycle switch 474 opens, the flip-flop 760 is set when the mid-cycle switch 462 is closed and a logic zero signal is applied to the lead 470. At this time the print solenoid 283 is deenergized.

Deenergizing the print solenoid 283 at mid-cycle results in the printing assembly 260 being operated through only one printing operation. Energization of the print solenoid 283 (FIG. 12) causes the arm 284 to move out of the way of the clutch actuator lever 285. This enables the clutch actuator lever and the clutch assembly 282 to rotate with the shaft 286. When the shaft 286 has rotated 180°, the clutch actuator lever is displaced from the position shown in FIG. 12. Therefore, deenergization of the print solenoid 283 at this time causes the arm 284 to move back into the path of movement of the clutch actuator lever 285 to actuate the clutch 282 to a disengaged condition when it reaches the position shown in FIG. 12.

Letter designations have been given to the various signals indicating conditions of the machine in accordance with the letter designations in FIGS. 13, 14, 15A, 15B, 15C, 15D and 15E. The various letter designations indicate the following signals:

A Indicates a logic one signal on lead 360 of FIG. 13
$\bar{A}$ Indicates a logic one signal on lead 422 of FIG. 13
B Indicates a logic one signal on lead 442 of FIG. 13
$\bar{B}$ Indicates a logic zero signal on lead 442 of FIG. 13
C Indicates a logic one signal on lead 456 of FIG. 14
$\bar{C}$ Indicates a logic zero signal on lead 456 of FIG. 14
D Indicates a logic one signal on lead 470 of FIG. 14
$\bar{D}$ Indicates a logic one signal on lead 468 of FIG. 14
E Indicates a logic one signal on lead 480 of FIG. 14
$\bar{E}$ Indicates a logic one signal on lead 482 of FIG. 14
F Indicates the automatic operation switch 306 is actuated
$\bar{F}$ Indicates automatic operation switch 306 is unactuated
G Indicates plate feed switch 302 is actuated
$\bar{G}$ Indicates plate feed switch 302 is unactuated
H Indicates skip switch 304 is actuated
$\bar{H}$ Indicates skip switch 304 is unactuated I Indicates print switch 500 is actuated
$\overline{I}$ Indicates print switch 500 is unactuated
J Indicates form feed switch 300 is actuated
$\overline{J}$ Indicates form feed switch 300 is unactuated Assuming the foregoing notations for the signals representing operating conditions of the machine, actuation of the main drive motor 202 can be represented by the following Boolean equation $$M = \overline{A}BCB_fC_f\overline{D} + D\overline{E} + E(F+I) + \overline{A}H$$

In this equation $B_f$ indicates a logic one output on the lead 644 (FIG. 15C) from the flip-flop 566. In addition, $C_f$ represents a logic one output from the flip-flop 590 (FIG. 15A) to the terminal 636 of the NAND gate 614.

The registration motor 107 is operated in accordance with the following Boolean equation:

$$R = \overline{B} + (FEC + IE)_f$$

The signals within the bracket set the flip-flop 566 (FIG. 15C) and run the registration motor 107 until the flip-flop is reset by the occurrence of a $\overline{B}$ signal.

The form feed solenoid 56 is energized in accordance with the following equation:

$$F = AJ + (\overline{FEC} + \overline{IE})_f$$

The form feed solenoid 56 is energized each time the switch 300 is actuated in the absence of a form at the printing station 20. The signals in the bracket of the above equation are utilized to set the flip-flop 566 of FIG. 15C. Whenever this flip-flop is reset by a $\overline{B}$ signal, the multivibrator 710 affects operation of the multivibrator 390 after a suitable time delay to energize the form feed solenoid 56.

The print solenoid 283 is energized in accordance with the following equation:

$$P = F + I$$

The print solenoid 233 is energized for the first half of an operating cycle whenever the print switch 500 is energized. The print solenoid 283 remains energized whenever the automatic operation switch 306 is actuated.

The ribbon feed solenoid 291 is energized in accordance with the following equation:

$$RF = (FEC + IE)_f$$

The signals in the bracket are set by the flip-flop 566 (FIG. 15C). Thus, whenever the flip-flop 566 is set the ribbon feed solenoid 291 is energized by the multivibrator 710.

What is claimed is:

1. In apparatus for printing on a sequence of sheets of material in turn at a printing station, each with a different one of a sequence of printing plates, which apparatus is cyclically operable and includes means for feeding sheets one by one into and away from the printing station, means for feeding plates one by one into and away from the printing station, both during a first portion of the cycle, and means for transferring an impression from a plate to a corresponding sheet during a second portion of the cycle, the improvement which comprises:

means for sensing for the presence of the sheets and plates at certain locations and for generating signals representative of the presence or absence of sheets and plates thereat, and circuit means controlling operation of the machine in accordance with said signals, said circuit means including:

means for signalling the transition from the first cycle portion to the second cycle portion;

means for analyzing the signals generated by the sensing means to determine whether, at the time of said transition, there exists a condition such that the printed sheet has been moved away from the printing station and a succeeding sheet is present in the printing station;

means for analyzing the signals generated by the sensing means to determine whether at the time of said transition there exists a condition such that the printing plate used to mark the printed sheet has been moved away from the printing position and a succeeding print plate is present therein;

means for generating a signal for continuation of operation of the apparatus providing the analyzing means signal that both of said conditions are affirmative;

manually operable control means for initiating feeding of a sheet to the printing station;

manually operable control means for initiating feeding of a plate to the printing station;

first control means for rendering said manually operable sheet control means effective only if the condition preventing continuation of operation is lack of a sheet at the printing station; and second control means for rendering said manually operable plate control means effective only if the condition preventing operation is lack of a plate at the printing station.

2. In apparatus for printing on a sequence of sheets of material in turn at a printing station, each with a different one of a sequence of printing plates, which apparatus includes means for feeding plates one by one into and away from the printing station, and printing means for causing each plate to print upon the corresponding sheet while both are at the printing station, the improvement which comprises:

a sensing element coacting directly with the sheets in the printing station for sensing directly the presence or absence of a sheet in the printing station and generating signals indicative of each conditions;

a sensing element coacting directly with the sheets just downstream from the printing station for sensing directly the presence or absence of a sheet in the process of leaving the printing station, and generating signals indicative of each condition;

a sensing element coacting directly with the plates in the printing station for sensing directly the presence or absence of a plate at the printing station and generating signals indicative of each condition;

circuit means for receiving and analyzing the signals generated by all of said sensing elements and determining whether or not, at the time for initiating a printing operation, the following conditions exist:

1. a sheet is present in the printing station,
2. a sheet has at some time since the previous printing operation appeared at a point just downstream of the printing station,
3. a plate is present in the printing station,
4. a plate has at some time been absent from the printing station since the previous printing operation, to thereby provide indication as to whether the sheet and plate have been changed, said circuit means including means for generating a signal for preventing operation of the printing means to cause printing unless all of said conditions 1, 2, 3 and 4 are affirmative.

3. In apparatus for printing on a sequence of sheets of material in turn at a printing station, each with a different one of a sequence of printing plates, which apparatus includes means for feeding sheets one by one into and away from the printing station, and printing means for causing each plate to print upon the corresponding sheet while both are at the printing station, the improvement which comprises:

a sensing element coacting directly with the sheets in the printing station for sensing directly the presence or absence of a sheet in the printing station and generating signals indicative of each condition;

a sensing element coacting directly with the sheets just downstream from the printing station for sensing directly the presence or absence of a sheet in the process of leaving the printing station, and generating signals indicative of each condition;

circuit means for receiving and analyzing the signals generated by both of said sensing elements and determining whether or not, at the time for initiating a printing operation, the following conditions exists:

1. a sheet is present in the printing station,
2. a sheet has at some time since the previous printing operation, appeared at a point just downstream of the printing station, to thereby provide indication as to whether said sheet has been changed, said circuit means including means for generating a signal for preventing operation of the printing means to cause printing unless both of said conditions 1 and 2 are affirmative.

4. In apparatus for printing on a sequence of sheets of material in turn at a printing station, each with a different one of a sequence of printing plates, which apparatus includes means for feeding sheets one by one into and away from the printing station, and printing means for causing each plate to print upon the corresponding sheet while both are at the printing station, the improvement which comprises:

a sensing element coacting directly with the plates in the printing station for sensing directly the presence or absence of a plate in the printing station and generating signals indicative of each condition;

circuit means for receiving and analyzing the signals generated by said sensing element and determining whether or not, at the time for initiating a printing operation, the following conditions exist:

1. a plate is present at the printing station,
2. a plate has at some time been absent from the printing station since the previous printing operation, to thereby provide indication as to whether said plate has been changed, said circuit means including means for generating a signal for preventing operation of the printing means to cause printing unless both of said conditions 1 and 2 are affirmative.

5. Apparatus for printing on each one of a plurality of sheets of material in turn at a printing station with a plurality of printing plates comprising:

first sheet feed means for moving each of the sheets into the printing station;

second sheet feed means for moving each of the sheets in turn away from the printing station;

plate feed means for moving each of the printing plates in turn into and away from the printing station;

printing means for causing each plate to print upon the corresponding sheet while both are at the printing station, said sheet feed means, plate feed means and printing means being cyclically operable in time relation to each other to effect the printing process;

first sensor means including a sensing element coacting directly with the sheets downstream of the printing station for directly detecting the presence or absence of a sheet downstream of the printing station during a cycle period in which a printed sheet normally would be in the process of being removed frm the printing station by the second sheet feed means and for generating signals indicative of the present or absent condition;

second sensor means including a sensing element coacting directly with the sheets in said printing station for directly detecting the presence or absence of a sheet in the printing station after the operation of the first sheet feeding means and during a period in the cycle just preceding the printing operation, and for generating signals indicative of the present or absent condition; and control means for said printing means connected to said sensor means for preventing operation of said printing means in response to a signal by either of said sensor means representing the absence of a sheet, thereby indicating failure to change the sheet between impressions.

6. Apparatus as set forth in claim 5 in which the first sheet feed means includes means for separating and starting a sheet from a sheet supply, and in which there is provided circuit means for energizing said separating and starting means at the appropriate cycle time, and including means for preventing such energization in case the first sensor means generates a signal indicative of an absent condition.

7. Apparatus for printing on each one of a plurality of sheets of material in turn at a printing station with a plurality of printing plates comprising:

sheet feed means for moving each of the sheets into and away from the printing station;

plate feed means for moving each of the printing plates in turn into and away from the printing station;

printing means for causing each plate to print upon the corresponding sheet while both are at the printing station, said sheet feed means, plate feed means and printing means being cyclically operable in time relation to each other to effect the printing process;

sensor means including a sensing element coacting directly with the printing plates in the printing station for directly detecting the presence or absence of a printing plate in the printing station at a first cycle time at which a printing plate normally would have been removed from the printing station and before the subsequent plate is fed, and the presence or absence of a succeeding printing plate in the printing station, during a second cycle time after the cycle plate feeding operation, and just prior to the printing operation, and for generating signals indicative of the present or absent condition in each case; and control means for said printing means connected to said sensor means for preventing of said printing means either in response to a signal by said sensor means representing the presence of a plate during the first cycle time, or the absence of a plate during the second cycle time, thereby indicating failure to change the plate between impressions.

8. Apparatus for printing on each one of a plurality of sheets of material in turn at a printing station with a plurality of printing plates comprising:

first sheet feed means for moving each of the sheets into the printing station;

second sheet feed means for moving each of the sheets in turn away from the printing station; plate feed means for moving each of the printing plates in turn into and away for the printing station;

printing means for causing each plate to print upon the corresponding sheet while both are at the printing station, said sheet feed means, plate feed means and printing means being cyclically operable in time relation to each other to effect the printing process;

first sensor means including a sensing element coacting directly with the sheets just downstream of the printing station for directly detecting the presence or absence of a sheet downstream of the printing station during a cycle period in which a printing sheet normally would be in the process of being removed from the printing station by the second sheet feed means and for generating signals indicative of the present or absent condition;

second sensor means including a sensing element coacting directly with the sheets in said printing station for directly detecting the presence or absence of a sheet in the printing station after the operation of the first sheet feeding means and during a period in the cycle just preceding the printing operation, and for generating signals indicative of the present or absent condition;

third sensor means including a sensing element coacting directly with the printing plates in the printing station for directly detecting the presence or absence of a printing plate in the printing station at a first cycle time at which a printing plate normally would have been removed from the printing station and before the subsequent plate is fed, and the presence or absence of succeeding printing plate in the printing station, during a second cycle time after the cyclic plate feeding operation, and just prior to the printing operation, and for generating signals indicative of the present or absent condition in each case; and control means for said printing means connected to said sensor mens for presenting operation of said printing means in response to a signal by either of said first or second sensor means representing the absence of a sheet, or in response to a signal by said third sensor means representing the presence of a plate during the first cycle time, or the absence of a plate during the second cycle time, thereby indicating failure to change the sheet or plate between impressions.

9. Apparatus as set forth in claim 8 in which the first sheet feed means includes means for separating and starting a sheet from a sheet supply, and in which there is provided circuit means for energizing said separating and starting means at the appropriate cycle time, and including means for preventing such energization in case the first sensor means generates a signal indicative of an absent condition.

* * * * *

UNITED STATES PATENT AND TRADEMARK OFFICE

CERTIFICATE OF CORRECTION

PATENT NO. : 4,030,409

DATED : June 21, 1977

INVENTOR(S) : Manoj C. Adhikari & Joseph G. Gardner

It is certified that error appears in the above-identified patent and that said Letters Patent are hereby corrected as shown below:

Col. 3, line 37, numeral "34" should read --94--.
Col. 5, line 54, numeral "26c" should read --26e--.
Col. 9, line 9, numeral "32" should read --302--.
Col. 10, line 42, "a pair of inverters connected with an OR gate" should read --an inverter--.
Col. 12, line 63, "as correspondence" should read --a corresponding--.
Col. 13, line 3, "is 652" should read --652 is--.
Col. 14, line 52, "deenergized" should be deleted;
line 55, "a" should read --an--.

Col. 26, line 61,
(Claim 7, line 24) "cycle" should read --cyclic--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*